US012366408B2

(12) United States Patent
Roberts et al.

(10) Patent No.: US 12,366,408 B2
(45) Date of Patent: Jul. 22, 2025

(54) OPEN LOOP LIQUEFACTION PROCESS WITH NGL RECOVERY

(71) Applicant: Honeywell LNG LLC, Charlotte, NC (US)

(72) Inventors: Mark Julian Roberts, Whitehall, PA (US); Russell B. Shnitser, Coopersburg, PA (US); Christopher Michael Ott, Macungie, PA (US); Annemarie Ott Weist, Macungie, PA (US)

(73) Assignee: HONEYWELL LNG LLC, Charoltte, NC (US)

( * ) Notice: Subject to any disclaimer, the term of this patent is extended or adjusted under 35 U.S.C. 154(b) by 0 days.

(21) Appl. No.: 17/965,883

(22) Filed: Oct. 14, 2022

(65) Prior Publication Data

US 2024/0125549 A1 Apr. 18, 2024

(51) Int. Cl.
*F25J 3/00* (2006.01)
*F25J 3/02* (2006.01)

(52) U.S. Cl.
CPC ..... *F25J 3/0209* (2013.01); *F25J 3/0233* (2013.01); *F25J 3/0238* (2013.01); *F25J 2200/06* (2013.01); *F25J 2200/40* (2013.01); *F25J 2200/74* (2013.01); *F25J 2205/04* (2013.01); *F25J 2210/60* (2013.01); *F25J 2210/62* (2013.01); *F25J 2215/60* (2013.01); *F25J 2245/02* (2013.01); *F25J 2270/06* (2013.01)

(58) Field of Classification Search
CPC ..... F25J 3/0209; F25J 3/0233; F25J 3/0238; F25J 2200/76; F25J 2205/04; F25J 2210/60; F25J 2215/60; F25J 2245/02; F25J 2270/40; F25J 2210/40
See application file for complete search history.

(56) References Cited

U.S. PATENT DOCUMENTS

| | | | | |
|---|---|---|---|---|
| 2008/0066493 | A1 | 3/2008 | Buijs et al. | |
| 2008/0098770 | A1 | 5/2008 | Ransbarger | |
| 2016/0258675 | A1 | 9/2016 | Kumar et al. | |
| 2018/0180354 | A1 | 6/2018 | Skinner et al. | |
| 2019/0154333 | A1* | 5/2019 | Mak | F25J 3/0242 |
| 2019/0310013 | A1 | 10/2019 | Zielinski et al. | |
| 2020/0141639 | A1* | 5/2020 | Mak | C10G 5/02 |
| 2020/0292230 | A1* | 9/2020 | Anguiano | F25J 3/0219 |
| 2021/0095921 | A1* | 4/2021 | Mak | F25J 3/0238 |
| 2021/0404738 | A1 | 12/2021 | Roberts et al. | |

OTHER PUBLICATIONS

Sebastien Lichtle et al, "Removing Heavy Hydrocarbons in Liquefaction Plant: The Advantage of NGL Recovery Units", Paper Presented At Spring Conference, Apr. 2015 In Hamburg, Gas Processors Association Europe, UK, Apr. 27, 2015, pp. 1-11.

(Continued)

*Primary Examiner* — Brian M King
(74) *Attorney, Agent, or Firm* — CANTOR COLBURN LLP

(57) ABSTRACT

Described herein are methods and systems for removing natural gas liquids from a natural gas feed stream and for liquefying the natural gas feed stream so as to produce a liquefied natural gas (LNG) stream and a natural gas liquids (NGL) stream.

18 Claims, 12 Drawing Sheets

(56) References Cited

OTHER PUBLICATIONS

Yuli Amalia Husnil ,et al, "Plant-wide control for the economic operation of modified single mixed refrigerant process for an offshore natural gas liquefaction plant", Chemical Engineering Research and Design, vol. 92, No. 4, Apr. 1, 2014, pp. 679-691.
Japanese Office Action for JP2023177331, Issued Nov. 5, 2024, 5 pages.
Saudi Arabia Office Action for application SA 123450537, Issued Feb. 16, 2025, 9 pages.
Canada Office Action for application CA 3,216,721, OA Issued Apr. 8, 2025, 4 pages.

* cited by examiner

OPEN LOOP LIQUEFACTION PROCESS WITH NGL RECOVERY

BACKGROUND

The present invention relates to a method and system for removing natural gas liquids (NGLs) from a natural gas feed stream and for liquefying the natural gas feed stream so as to produce a liquefied natural gas (LNG) stream and a natural gas liquids (NGL) stream.

Removal of the heavy hydrocarbons (also referred to herein as "HHCs"), such as C6+ hydrocarbons (hydrocarbons having 6 or more carbon atoms) and aromatics (e.g. benzene, toluene, ethylbenzene and xylenes), from natural gas prior to liquefaction of the natural gas is often desirable in order to avoid freeze-out of these components in the heat exchangers used to liquefy the natural gas. C2 to C5+ hydrocarbons (hydrocarbons having 2 to or more carbon atoms), also referred to in the art as natural gas liquids (or "NGLs"), are typically also separated from natural gas because they have a relatively high market value.

Traditionally, removing NGLs (and HHCs) from a rich natural gas feed stream (a natural gas feed stream rich in said components) has involved use of a stand-alone front-end NGL extraction operating at low to medium pressure. Additional equipment is then required to increase the feed pressure in order to efficiently liquify the natural gas.

US patent application US 2018/0180354 A1 depicts a method and system for liquefying natural gas, in which the compressed refrigerant stream exiting the refrigerant compressor is split into first and second portions. The first portion of the compressed refrigerant is combined with the natural gas feed stream, before said natural gas feed stream is then precooled in a precooler, expanded in an expander and introduced into a phase separator (or the upper part of a demethaniser column) where it is separated into vapor and liquid fractions, the vapor fraction being withdrawn from the phase separator and warmed in a first heat exchanger before being routed to the refrigerant compressor. The second portion of the refrigerant stream is cooled in the first heat exchanger section before being further split into third and fourth portions, with the third portion being further cooled and liquefied in a second heat exchanger to provide the LNG product, and with the fourth portion being expanded in an expander and separated in a phase separator into vapor and liquid fractions, with the vapor fraction being withdrawn from the phase separator, warmed in the second heat exchanger, and then further warmed in the first heat exchanger before being routed to the refrigerant compressor.

BRIEF SUMMARY

Disclosed herein are methods and systems for removing NGLs from and liquefying a natural gas feed stream, in which a front-end natural gas liquids (NGL) unit is integrated with a natural gas liquefaction unit that uses an open loop refrigeration cycle. The Integrated approach disclosed herein can remove the need for feed compression equipment, while still achieving similar levels of natural gas liquids recovery and aromatics extraction to those achievable using a standalone front-end NGL unit. The open-loop refrigeration cycle also removes the need for equipment, piping, and instrumentation associated with refrigerant storage and injection in the liquefaction unit (since in the open-loop refrigerant cycle the feed serves as a continuous source of the refrigerant). Such reductions in equipment and operating complexity lead to reduced capital costs and increased operating efficiency.

Several preferred aspects of the methods and systems according to the present invention are outlined below.

Aspect 1: A method for removing natural gas liquids from and liquefying a natural gas feed stream, the method comprising the steps of:

(a) expanding and/or cooling a natural gas feed stream and introducing said stream into a distillation column having one or more separation sections, the natural gas feed stream being introduced into the distillation column below at least one of said separation sections;

(b) withdrawing a natural gas liquids stream from the bottom of the distillation column;

(c) withdrawing a natural gas vapor stream from the top of the distillation column (d) warming the natural gas vapor stream and a first expanded refrigerant stream in one or more heat exchanger sections, compressing the resulting warmed streams, and combining said streams to form a compressed refrigerant, wherein the natural gas vapor stream and first expanded refrigerant stream may be combined prior to, during or after being warmed and compressed;

(e) cooling at least a first portion of the compressed refrigerant, via indirect heat exchange with the natural gas vapor stream and the first expanded refrigerant stream that are being warmed in step (d), to form a first cold refrigerant stream;

(f) expanding the first cold refrigerant stream and separating said stream into vapor and liquid phases to form a first liquefied natural gas stream from the liquid phase and the first expanded refrigerant stream from the vapor phase;

(g) forming a reflux stream and expanding and introducing the reflux stream into the top of the distillation column to provide reflux to the distillation column, wherein the reflux stream is formed from a portion of the first liquefied natural gas stream, a portion of the liquid phase separated in step (f), a portion of the first cold refrigerant stream withdrawn from said stream prior to said stream being separated in step (f), a further portion of the compressed refrigerant that has been cooled via indirect heat exchange with the natural gas vapor stream and the first expanded refrigerant stream that are being warmed in step (d), and/or a portion of a liquefied natural gas stream or liquefied natural gas product derived from the first liquefied natural gas stream.

Aspect 2: A method according to Aspect 1, wherein in step (a) the natural gas feed stream is introduced into a distillation column having two or more separation sections, the expanded natural gas feed stream being introduced into the distillation column below at least one of said separation sections and above at least another one of said separation sections.

Aspect 3: A method according to Aspect 2, wherein the method further comprises the step of:

(h) providing boil-up to the distillation column by reboiling a portion of the distillation column bottoms liquid.

Aspect 4: A method according to any one of Aspects 1 to 3, wherein in step (a) the natural gas feed stream is expanded before being introduced into the distillation column.

Aspect 5: A method according to Aspect 4, wherein in step (a) the natural gas feed stream is cooled and then expanded before being introduced into the distillation column, wherein after being cooled the natural gas feed stream is separated into vapor and liquid phases with the vapor phase being expanded and introduced into the distillation column at a first location below at least one separation section of the column, and with the liquid phase being expanded and introduced into the distillation column at a second location below the first location, there being at least one separation section between the first and second locations.

Aspect 6: A method according to any one of Aspects 1 to 5, wherein in step (a) the natural gas feed stream is cooled before being introduced into the distillation column, at least a portion the natural gas feed stream being cooled via indirect heat exchange with the natural gas vapor stream and the first expanded refrigerant stream that are being warmed in step (d).

Aspect 7: A method according to any one of Aspects 1 to 6, wherein in step (g) the reflux stream is formed from a portion of the first liquefied natural gas stream and/or a portion of the liquid phase separated in step (f).

Aspect 8: A method according to any one of Aspects 1 to 7, wherein the first expanded refrigerant stream is formed at a lower temperature than the natural gas vapor stream, and wherein in step (e) the at least a first portion of the compressed refrigerant is cooled via indirect heat exchange with the natural gas vapor stream and the first expanded refrigerant stream and then further cooled via indirect heat exchange with the first expanded refrigerant stream to form the first cold refrigerant stream.

Aspect 9: A method according to any one of Aspects 1 to 8, wherein step (e) comprises cooling the first portion of the compressed refrigerant and a second portion of the compressed refrigerant, via indirect heat exchange with the natural gas vapor stream and the first expanded refrigerant stream that are being warmed in step (d), to form respectively the first cold refrigerant stream and a second cold refrigerant stream, the first and second portions of the compressed refrigerant being cooled against the natural gas vapor stream and the first expanded refrigerant stream and the first portion of the compressed refrigerant being then further cooled against the natural gas vapor stream and the first expanded refrigerant stream such that the first cold refrigerant stream is formed at a lower temperature than the second cold refrigerant stream; and wherein step (f) comprises expanding the first cold refrigerant stream, expanding the second cold refrigerant stream, and combining and separating said streams into vapor and liquid phases to form the first liquefied natural gas stream from the liquid phase and the first expanded refrigerant stream from the vapor phase.

Aspect 10: A method according to any one of Aspects 1 to 9, wherein the method further comprises the step of:

(i) expanding a third portion of the compressed refrigerant to form a second expanded refrigerant stream, wherein the second expanded refrigerant stream is formed at a higher temperature than the first expanded refrigerant stream or the natural gas vapor stream;

wherein step (d) comprises warming the natural gas vapor stream, the first expanded refrigerant stream and the second expanded refrigerant stream in one or more heat exchanger sections, compressing the resulting warmed streams, and combining said streams to form a compressed refrigerant, wherein the natural gas vapor stream, first expanded refrigerant stream and second expanded refrigerant stream may be combined prior to, during or after being warmed and compressed; and wherein step (e) comprises cooling the at least a first portion of the compressed refrigerant, via indirect heat exchange with the natural gas vapor stream, the first expanded refrigerant stream and the second expanded refrigerant stream that are being warmed in step (d), to form the first cold refrigerant stream, the at least a first portion of the compressed refrigerant being cooled against the natural gas vapor stream, the first expanded refrigerant stream and the second expanded refrigerant stream before being further cooled against the natural gas vapor stream and the first expanded refrigerant stream.

Aspect 11: A method according to Aspect 10, wherein step (e) comprises cooling the first portion of the compressed refrigerant and a second portion of the compressed refrigerant, via indirect heat exchange with the natural gas vapor stream, the first expanded refrigerant stream and the second expanded refrigerant stream that are being warmed in step (d), to form respectively the first cold refrigerant stream and a second cold refrigerant stream, the first and second portions of the compressed refrigerant being cooled against the natural gas vapor stream, the first expanded refrigerant stream and the second expanded refrigerant stream, and the first portion of the compressed refrigerant being then further cooled against the natural gas vapor stream and the first expanded refrigerant stream such that the first cold refrigerant stream is formed at a lower temperature than the second cold refrigerant stream; and wherein step (f) comprises expanding the first cold refrigerant stream, expanding the second cold refrigerant stream, and combining and separating said streams into vapor and liquid phases to form the first liquefied natural gas stream from the liquid phase and the first expanded refrigerant stream from the vapor phase.

Aspect 12: A method according to any one of Aspects 9 to 11, wherein the second cold refrigerant stream is expanded in an expander portion of a compander having a compressor portion that is used for compressing at least a portion of the natural gas vapor stream and/or first expanded refrigerant stream in step (d); and/or wherein the third portion of the compressed refrigerant is expanded in an expander portion of a compander having a compressor portion that is used for compressing at least a portion of the natural gas vapor stream and/or first expanded refrigerant stream in step (d).

Aspect 13: A method according to any one of Aspects 1 to 12, wherein in step (f) the first cold refrigerant stream is the separated into vapor and liquid phases in a phase separator.

Aspect 14: A method according to any one of Aspects 1 to 13, wherein the method further comprises the step of:

(j) further cooling at least a portion of the first liquefied natural gas stream to form a liquefied natural gas product stream.

Aspect 15: A method according to Aspect 14, wherein step (j) comprises flashing at least a portion of the first liquefied natural gas stream to form the liquefied natural gas product stream and one or more flash gas streams.

Aspect 16: A method according to Aspect 15, wherein the method further comprises the step of:

(k) cooling and liquefying a fourth portion of the of the compressed refrigerant via indirect heat exchange with the one or more flash gas streams to form a second liquefied natural gas stream or set of liquefied natural gas streams; and wherein step (j) comprises flashing the at least a portion of the first liquefied natural gas stream and the second liquefied natural gas stream or set of liquefied natural gas streams to form the liquefied natural gas product stream and the one or more flash gas streams.

Aspect 17: A method according to Aspect 16, wherein the method further comprises the step of:

(l) cooling a fifth portion of the compressed refrigerant via indirect heat exchange with the one or more flash gas streams and then combining the fifth portion of the compressed refrigerant with the first portion of the compressed refrigerant during the cooling of the at least a first portion of the compressed refrigerant in step (e) to form the first cold refrigerant stream.

Aspect 18: A method according to any one of Aspects 15 to 17, wherein the method further comprises the step of:

(m) compressing the one or more flash gas streams to form a compressed flash gas stream, and cooling and liquefying the compressed flash gas stream, via indirect heat exchange with the natural gas vapor stream and the first expanded refrigerant stream that are being warmed in step (d), to form a third liquefied natural gas stream; and wherein step (j) comprises flashing the at least a portion of the first liquefied natural gas stream and the third liquefied natural gas stream to form the liquefied natural gas product stream and the one or more flash gas streams Aspect 19: A method according to any one of Aspects 15 to 17, wherein the method further comprises the step of:

(m) compressing and combining the one or more flash gas streams with the natural gas vapor stream and the first expanded refrigerant stream to form the compressed refrigerant.

Aspect 20: A system for removing natural gas liquids from and liquefying a natural gas feed stream, the system comprising:

one or more expansion devices and/or heat exchanger sections arranged and configured to expanding and/or cool a natural gas feed stream to form an expanded and/or cooled natural gas feed stream;

a distillation column having one or more separation sections, the distillation column being arranged and configured to receive the expanded and/or cooled natural gas feed stream into the distillation column below at least one of said separation sections and separate expanded and/or cooled natural gas feed stream into a natural gas liquids stream withdrawn from the bottom of the distillation column and a natural gas vapor stream withdrawn from the top of the distillation column;

one or more conduits, heat exchanger sections and compression stages arranged and configured to receive and warm the natural gas vapor stream and a first expanded refrigerant stream, compress the resulting warmed streams and combine said streams to form a compressed refrigerant, wherein the one or more conduits, heat exchanger sections and compression stages and may be arranged and configured such that the natural gas vapor stream and first expanded refrigerant stream are combined prior to, during or after being warmed and compressed;

one or more conduits arranged and configured to pass at least a first portion of the compressed refrigerant through the one or more heat exchanger sections so as to cool the at least a first portion of the compressed refrigerant via indirect heat exchange with the natural gas vapor stream and the first expanded refrigerant stream to form a first cold refrigerant stream;

one or more expansion and separation devices for expanding the first cold refrigerant stream and separating said stream into vapor and liquid phases to form a first liquefied natural gas stream from the liquid phase and the first expanded refrigerant stream from the vapor phase; and one or more conduits and expansion devices arranged and configured to receive a reflux stream and expand and introduce the reflux stream into the top of the distillation column to provide reflux to the distillation column, wherein the reflux stream is formed from a portion of the first liquefied natural gas stream, a portion of the liquid phase separated in step (f), a portion of the first cold refrigerant stream withdrawn from said stream prior to said stream being separated in step (f), a further portion of the compressed refrigerant that has been cooled via indirect heat exchange with the natural gas vapor stream and the first expanded refrigerant stream that are being warmed in step (d), and/or a portion of a liquefied natural gas stream or liquefied natural gas product derived from the first liquefied natural gas stream.

BRIEF DESCRIPTION OF THE DRAWINGS

FIG. 10 is a schematic flow diagram depicting a flash gas compressor arrangement suitable for use in the method and system of FIG. 1.

DETAILED DESCRIPTION

Figure 1:
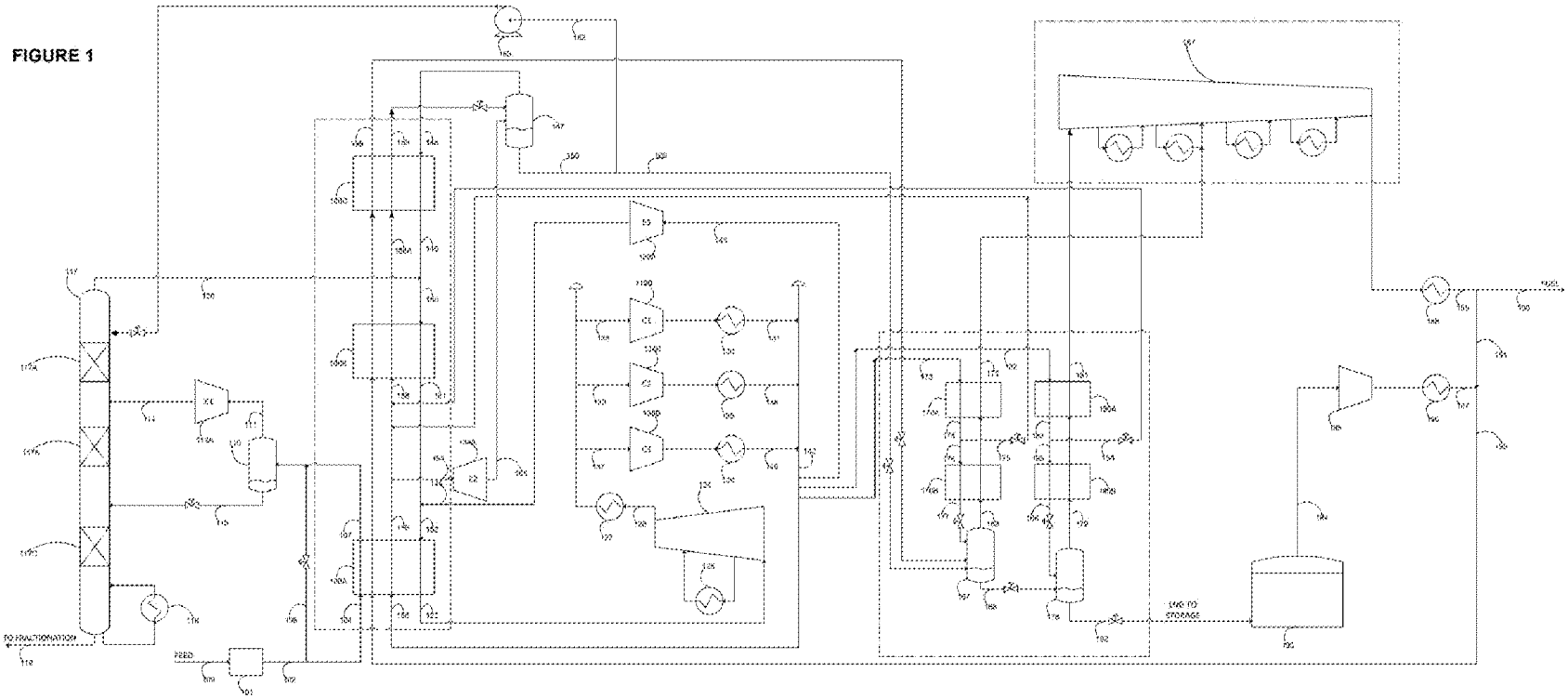
FIG. 1 is a schematic flow diagram depicting a method and system for removing NGLs from and liquefying a natural gas feed stream according to a first embodiment of the present invention.

Described herein are methods and systems for removing NGLs from and liquefying a natural gas feed stream so as to produce an LNG stream and an NGL stream.

As used herein and unless otherwise indicated, the articles "a" and "an" mean one or more when applied to any feature in embodiments of the present invention described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used.

Where letters are used herein to identify recited steps of a method (e.g. (a), (b), and (c)), these letters are used solely to aid in referring to the method steps and are not intended to indicate a specific order in which claimed steps are performed, unless and only to the extent that such order is specifically recited.

Where used herein to identify recited features of a method or system, the terms "first", "second", "third" and so on, are used solely to aid in referring to and distinguishing between the features in question and are not intended to indicate any specific order of the features, unless and only to the extent that such order is specifically recited.

As used herein, the term "natural gas" encompasses also synthetic and/or substitute natural gases. The major component of natural gas is methane (which typically comprises at least 85 mole %, more often at least 90 mole %, and on average about 95 mole % of the feed stream). Other typical components of raw natural gas that may be present in smaller amounts include one or more "light components" (i.e. components having a lower boiling point than methane) such as nitrogen, helium, and hydrogen, and/or one or more "heavy components" (i.e. components having a higher boiling point than methane) such as carbon dioxide and other acid gases, moisture, mercury, and heavier hydrocarbons such as ethane, propane, butanes, pentanes, etc. However, prior to being liquefied the raw natural gas feed stream will be treated if and as necessary in order to reduce the levels of any heavy components that may be present down to such levels as are needed to avoid freezing or other operational problems in the heat exchanger section or sections in which the natural gas is to be cooled and liquefied.

As used herein, the term "liquefied natural gas" refers to natural gas that is in the liquid phase or, in relation to natural gas that is at a temperature and pressure above its critical point (i.e. that is a supercritical fluid), to natural gas that is at a density greater than its critical point density. Likewise, references to "liquefying" a natural gas refer to the conversion (typically by cooling) of a natural gas from vapor to liquid (i.e. from the gaseous to liquid phase) or, in relation to natural gas that is at a temperature and pressure above its critical point, to the act of increasing (typically by cooling) the density of the natural gas to a density greater than its critical point density.

As used herein, the term "indirect heat exchange" refers to heat exchange between two fluids where the two fluids are kept separate from each other by some form of physical barrier.

As used herein, the term "heat exchanger section" refers to a unit or a part of a unit in which indirect heat exchange is taking place between one or more streams of fluid flowing through the cold side of the heat exchanger section and one or more streams of fluid flowing through the warm side of the heat exchanger section, the stream(s) of fluid flowing through the cold side being thereby warmed, and the stream(s) of fluid flowing the warm side being thereby cooled (the terms "warm side" and "cold side" being purely relative). Unless otherwise indicated, a heat exchanger section may a heat exchanger section of any suitable type, such as but not limited to a heat exchanger section of a shell and tube, coil wound, or plate and fin type of heat exchanger.

As used herein, the terms "coil wound heat exchanger" and "coil wound heat exchanger unit" refer to a heat exchanger of the type known in the art, comprising one or more tube bundles encased in a shell casing. A "coil wound heat exchanger section" comprises one or more of said tube bundles, the "tube side" of said bundle(s), i.e. the interior of the tubes in the bundle(s), typically representing the warm side of said section and defining one or more passages (also referred to as tube circuits) through the section, and the "shell side" of said bundle(s), i.e. the space between and defined by the interior of the shell casing and exterior of the tubes, typically representing the cold side of said section and defining a single passage through the section. The shell side is almost always used as the cold side of the section, with the refrigerant providing cooling duty to the section being therefore passed through the shell side, because the shell side provides much lower flow resistance and allows for a much greater pressure drop than the tube side which makes passing expanded streams of cold refrigerant through the shell side much more effective and efficient. Coil wound heat exchangers are a compact design of heat exchanger known for their robustness, safety, and heat transfer efficiency, and thus have the benefit of providing highly efficient levels of heat exchange relative to their footprint. However, because the shell side defines only a single passage through the heat exchanger section it is not possible use more than one stream of refrigerant in the shell side of the coil wound heat exchanger section without said streams of refrigerant mixing in the shell side of said heat exchanger section.

As used herein, the term "flashing" (also referred to in the art as "flash evaporating") refers to the process of reducing the pressure of a liquid (or supercritical or two-phase) stream so as to cool the stream and vaporize some of the liquid resulting in a colder, lower pressure two-phase mixture of vapor and liquid, the vapor present in this mixture also being referred to as the "flash gas". As use herein, the phrase "flashing and separating" refers to the process of flashing a stream and separating the flash gas from the remaining liquid.

As used herein, the phrases "gaseous stream of refrigerant" and "gaseous refrigerant stream" refer to a stream of refrigerant where substantially all, and more preferably all of the stream is vapor (i.e. is in the gaseous phase). Preferably, the stream is at least 80 mole % vapor (i.e. has a vapor fraction of at least 0.8). More preferably the stream is at least 90 mole %, at least 95 mole %, or at least 99 mole % vapor.

As used herein, the term "expansion device" refers to any device or collection of devices suitable for expanding and thereby lowering the pressure of a fluid. Suitable types of expansion device for expanding a fluid include "isentropic" expansion devices, such as expanders (i.e. turbo-expanders) or hydraulic turbines, in which the fluid is expanded and the pressure and temperature of the fluid thereby lowered in a substantially isentropic manner (i.e. in a manner that generates works); and "isenthalpic" expansion devices, such as valves or other throttling devices, in which the fluid is expanded and the pressure and temperature of the fluid thereby lowered without the generating work.

As used herein, the term "separation device" refers to any device or collection of devices suitable for separating a two-phase (vapor and liquid) stream or mixture into separate vapor (gas) and liquid streams. Exemplary of separation devices include phase separators and distillation columns.

As used herein, the term "distillation column" refers to a column containing one or more separation sections, each separation section being composed of one or more separation stages (composed of devices such as packing or trays) that increase contact and thus enhance mass transfer between the upward rising vapor and downward flowing liquid inside the column such that the liquid and vapor streams exiting the column are not in equilibrium (the concentration of higher volatility components being increased in the upward rising vapor and the concentration of lower volatility components being increased in the downward flowing liquid). The term "overhead vapor" refers to the vapor that collects at the top of the column. The term "bottoms liquid" refers to the liquid that collects at the bottom of the column. The "top" of the column refers to the part of the column above the separation sections (i.e. at or above the top-most separation stage). The "bottom" of the column refers to the part of the column below the separation sections (i.e. at or below the bottom-most separation stage). An "intermediate location" of the column refers to a location between the top and bottom of the column, between two separation sections. The term "reflux" refers to a source of downward flowing liquid from the top of the column. The term "boil-up" refers to a source of upward rising vapor from the bottom of the column, typically generated by boiling ("re-boiling") a portion of the bottoms liquid.

The term "phase separator" refers to a drum or other form of vessel in which a two-phase stream can separate into its constituent vapor and liquid phases where the liquid and vapor streams exiting the vessel are in equilibrium (there being no separation stages inside a phase separator).

Solely by way of example, various exemplary embodiments of the invention will now be described with reference to the Figures. In the Figures, where a feature is common to more than one Figure that feature has been assigned the same reference numeral. Unless a feature is specifically described as being different from other embodiments in which it is shown in the drawings, that feature can be assumed to have the same structure and function as the corresponding feature in the embodiment in which it is described. Moreover, if that feature does not have a different structure or function in a subsequently described embodiment, it may not be specifically referred to in the specification.

Referring to FIG. 1, a method and system for removing NGLs from and liquefying a natural gas feed stream in accordance with a first embodiment of the present invention is shown.

A natural gas feed stream 100, containing also a mixture of NGLs and HHCs (including aromatics) and typically at ambient temperature and a high-pressure, typically between 50 and 100 bara and more preferably between 70 and 95 bara, is routed to a pretreatment section 101. Depending on the composition of the natural gas feed, the pretreatment of the natural gas feed stream 100 in the pretreatment section 101 can comprise treating the natural gas feed stream in an acid gas removal unit for removing $H_2S$ and $CO_2$, a dehydration unit for removing water, and/or a mercury removal unit.

The pretreated natural gas feed stream 102 exiting the pretreatment section 101 is then precooled by passing at least a portion of the natural gas feed stream through the warm side of a first heat exchanger section 106A of a main heat exchanger, said at least a portion of the natural gas feed stream being precooled via indirect heat exchange with a combined natural gas vapor, first expanded refrigerant and second expanded refrigerant stream 152 (that will be described in more detail below) passing through the cold side of the first heat exchanger section 106A. In the illustrated embodiment this is done by splitting the pretreated natural gas feed stream 102 exiting the pretreatment section 101 into two streams, namely a bypass stream 108 consisting of between 20 and 60 percent and more preferably between 30 and 50 percent of the flow the pretreated natural gas feed stream 102 that bypasses the first heat exchanger section 106A, and a feed stream 104 consisting of the remainder of the of the flow the pretreated natural gas feed stream 102 that is passed through a circuit (i.e. one or more passages) in the warm side of the first heat exchanger section 106A and cooled to from a precooled feed stream 107 at a temperature of between −40° C. and −20° C., and more preferably between −35° C. and −25° C., that is then recombined with the bypass stream 108 and introduced into a high pressure (HP) phase separator 110.

The HP phase separator 110 operates at a pressure of between 50 and 100 bara, and more preferably between 70 and 95 bara. In the HP phase separator 110 the pretreated and precooled natural gas feed stream is separated into vapor and liquid phases. The vapor phase of the natural gas feed stream is withdrawn from the HP phase separator 110 as stream 111 and expanded in a first expander 112A forming an expanded stream 114 that is introduced into a distillation column 117 at a first intermediate location of the column, below separation section 117A of the column and above separation section 117B of the column. The liquid phase of the natural gas feed stream is withdrawn from the HP phase separator 110 as stream 115, expanded across a J-T valve and introduced into the distillation column 117 at a second intermediate location below separation section 117B of the column (which section is therefore positioned between the first and second intermediate locations) and above separation section 117C of the column.

The distillation column 117 preferably operates at a pressure of between 20 and 40 bara and more preferably between 25 and 30 bara. Reflux to the distillation column 117 is provided by a reflux stream 162 (which will be described in more detail below) that is expanded across a J-T valve and introduced into the top of the distillation column 117, above separation section 117A. Boil-up for the distillation column 117 is provided by re-boiling a portion of the distillation column bottoms liquid in a reboiler 118. Heating duty for re-boiling the portion of the bottoms liquid in the reboiler 118 can be provided by a stream of steam or another heat transfer fluid that is passed through and cooled in the reboiler via indirect heat exchange with the portion of the bottoms liquid. With certain feed compositions the reboiler 118 could, in an alternative embodiment, be integrated into the first heat exchanger section 106A, with the portion of the bottoms liquid being passed through and warmed in a circuit (i.e. one or more passages) in the cold side of the heat exchanger section 106A, the heating duty for re-boiling the portion of the bottoms liquid being in this case provided by one or more streams passing through the warm side of the first heat exchanger section 106A. In yet another embodiment, the reboiler 118 could be replaced or supplemented by injecting a warm process stream into the bottom of the distillation column 117.

Inside the distillation column 117, upward rising vapor from the natural gas feed stream (i.e. from streams 114 and 115) is brought into contact with downward flowing liquid from the reflux stream as they pass through the separation stages inside the distillation column 117, thereby "scrubbing" components heavier than methane from said upward rising vapor (i.e. removing at least some of said components of lower volatility than methane from the vapor). Likewise, downward flowing liquid from the natural gas feed stream is brought into contact with upward rising vapor from the bottom of the column as they pass through the separation stages inside the distillation column 117, thereby "stripping" methane and components lighter than methane from said downward flowing liquid (i.e. removing at least some of the methane and components of higher volatility than methane from the liquid). As such, the natural gas feed stream is separated inside the distillation column 117 into a methane-rich vapor fraction, collected as the distillation column overhead vapor, and a liquid fraction, enriched in hydrocarbons heavier than methane, collected as the distillation column bottoms liquid.

A NGL stream 119, formed of the distillation column bottoms liquid, is withdrawn from the bottom of the distillation column. The NGL stream 119 has a high aromatics content along with NGLs and HHCs, and is at a temperature of between 80° C. and 40° C. and more preferably between 70° C. and 50° C. The percentage of C3+ components from the natural gas feed stream 102 that are recovered in the NGL Stream 119 can be higher than 90 mol % (as calculated from the sum of molar flow rate of all C3+ components in the NGL stream 119 divided by the sum of the molar flow rate of all C3+ components in the natural gas feed stream 102).

A natural gas vapor stream 120, formed of the distillation column overhead vapor, is withdrawn from the top of the distillation column. The natural gas vapor stream 120 is at a temperature of between −90° C. and −60° C. and more preferably between −80° C. and −70° C., and typically contains less than 0.1 mol % of C5+ hydrocarbons (i.e. the sum of all C5+ hydrocarbons in the natural gas vapor stream 120 totals less than 0.1 mol % of the stream) and less than 1 mol ppm of aromatics (i.e. the sum of all aromatics in the natural gas vapor stream 120 totals less than 1 mol ppm of the stream).

A first expanded refrigerant stream 148 is passed through the cold side of a third heat exchanger section 106C of the main heat exchanger where it is warmed to a temperature of between −100° C. and −60° C. and more preferably between −90° C. and −70° C. The first expanded refrigerant stream 149 exiting the cold side of the third heat exchanger section 106C is then combined with the natural gas vapor stream 120 to form a combined natural gas vapor and first expanded refrigerant stream 150. The combined natural gas vapor and first expanded refrigerant stream 150 is passed through the cold side of a second heat exchanger section 106B of the main heat exchanger where it is warmed to a temperature of between −60° C. and −20° C. and more preferably between −50° C. and −30° C. The combined natural gas vapor and first expanded refrigerant stream 151 exiting the cold side of the second heat exchanger section 106B is then combined with a second expanded refrigerant stream 144 to form the combined natural gas vapor, first expanded refrigerant and second expanded refrigerant stream 152. The combined natural gas vapor, first expanded refrigerant and second expanded refrigerant stream 152 is then passed through the cold side of the first heat exchanger section 106A of the main heat exchanger where it is warmed to within a few degrees centigrade of the temperature of the pretreated natural gas feed stream 104 entering said heat exchanger section.

The combined natural gas vapor, first expanded refrigerant and second expanded refrigerant stream 122 exiting the cold side of the first heat exchanger section 106A is then sent to a compression system comprising a plurality of compression stages in order to be compressed to form a compressed refrigerant 142.

More specifically, the combined natural gas vapor, first expanded refrigerant and second expanded refrigerant stream 122 exiting the cold side of the first heat exchanger section 106A is first compressed a multi-stage refrigerant compressor 124, putting out for example 15,000 to 10,000 meters of head. In the illustrated embodiment, the multi-stage refrigerant compressor 124 has an intercooler 125 (which improves compression efficiency), although this may be excluded depending on equipment design and total head across the refrigerant compressor 124. The compressed stream 126 exiting the multi-stage refrigerant compressor is then cooled in aftercooler 127 before being split between and further compressed in three parallel compression stages 112B, 134B and 138B, and cooled in three associated aftercoolers 130, 135, and 139, forming three further compressed streams 131, 140, 136 that are then recombined to form the compressed refrigerant 142. The parallel compression stages 112B, 134B, 138B, associated aftercoolers 130, 135, and 139, multi-stage refrigerant compressor 124, and associated intercooler 125 and aftercooler 127 can all be run in multiple strings.

The compressed refrigerant 142, which is at a pressure of 100 to 80 bara, is then divided into several refrigerant streams 155, 143, 173, 182.

Stream 155, representing first and second portions of the compressed refrigerant 142, is passed through a circuit (i.e. one or more passages) in the warm side of the first heat exchanger section 106A (separately from the circuit through which the natural gas feed stream 104 is passed) and cooled to a temperature of between −40° C. and −20° C., and more preferably between −35° C. and −25° C., via indirect heat exchange with the combined natural gas vapor, first expanded refrigerant and second expanded refrigerant stream 152 passing through the cold side of said heat exchanger section. The resulting cooled stream 156 is then divided into said first and second portions of the compressed refrigerant, the second portion of the compressed refrigerant forming second cold refrigerant stream 164, consisting of between 90 and 70 percent and more preferably between 85 and 75 percent of the flow of stream 156, and the first portion of the compressed refrigerant forming stream 158 consisting of the remainder of the flow of stream 156. In an alternative embodiment, instead of being passed through and cooled in the warm side of the first heat exchanger section 106A as a single stream, the first and second portions of the compressed refrigerant could be taken as separate streams that are passed through and cooled in separate circuits in the warm side of the first heat exchanger section to form streams 158 and 164.

Stream 158, comprising the first portion of the compressed refrigerant, is passed through a circuit in the warm side of the second heat exchanger section 106B where it is further cooled via indirect heat exchange with the combined natural gas vapor and first expanded refrigerant stream 150 passing through the cold side of said heat exchanger section, and is then is passed through a circuit in the warm side of the third heat exchanger section 106C where it is further cooled via indirect heat exchange with the first expanded refrigerant stream 148 passing through the cold side of said heat exchanger section, forming a first cold refrigerant stream 159 that is withdrawn from the warm side of the third heat exchanger section 106C at a temperature of between −105° C. and −80° C. and more preferably between −100° C. and −90° C.

The first cold refrigerant stream 159 and the second cold refrigerant stream 164 are then expanded, combined and separated into vapor and liquid phases to form a first liquefied natural gas stream 160 from the liquid phase and the first expanded refrigerant stream 148 from the vapor phase.

More specifically, in the embodiment illustrated in FIG. 1 the first cold refrigerant stream 159 is expanded across a J-T valve, the second cold refrigerant stream 164 is expanded in a second expander 134A, and the two streams are then introduced into and combined in a low pressure (LP) phase separator 147 where they are separated into vapor and liquid phases, with the vapor phase being withdrawn from the LP phase separator 147 to form the first expanded refrigerant stream 148 (that is then sent to the cold side of the third heat exchange section 106C of the main heat exchanger), and the liquid phase being withdrawn from the LP phase separator 147 to form the first liquefied natural gas stream 160. Although in the depicted embodiment the first and second cold refrigerant stream are introduced separately into the LP phase separator 147, they could instead be combined after being expanded but before being introduced into the LP phase separator 147. Alternatively, more than one LP phase separator could be used, with the first and second cold refrigerant streams being introduced into and separated in different LP phase separators with the vapor phases of the separators being then withdrawn and combined and the liquid phases of the separators being then withdrawn and combined.

Stream 143, representing a third portion of the compressed refrigerant 142, is expanded in a third expander 138A to form the second expanded refrigerant stream 144 that is then combined with the combined natural gas vapor and first expanded refrigerant stream 151 to form the combined natural gas vapor, first expanded refrigerant and second expanded refrigerant stream 152 (as described above).

In the embodiment illustrated in FIG. 1, the first expander 112A is an expander portion of a first compander, the compressor portion of which is formed by a first compression stage 112B of the three parallel compression stages; the second expander 134A is an expander portion of a second compander, the compressor portion of which is formed by a second compression stage 134B of the three parallel compression stages; and the third expander 138A is an expander portion of a third compander, the compressor portion of which is formed by a third compression stage 138B of the three parallel compression stages. In an alternative embodiment, the expansion work from the first, second and/or third expanders could instead be recovered in a generator. However, in such an arrangement the either first, second and/or third compression stages 112B, 134B, 138B would have to be driven by a different power source, or if one or more of said compression stages were to be dispensed with then the head generated in said compression stages would need to be made up by the multi stage refrigerant compressor 124.

The first liquefied natural gas stream 160 is divided, with a first portion of the stream forming the reflux stream 162 that is pumped by reflux pump 163 to the distillation column 117 and then, as previous described, expanded across a J-T valve and introduced into the top of the distillation column 117 to provide reflux to the distillation column. The reflux stream 162 is at a temperature of between −105° C. and −80° C. and more preferably between −100° C. and −90° C., and consists of between 5 and 20 percent and more preferably between 10 and 15 percent of the flow of the first liquefied natural gas stream 160. In an alternative embodiment, instead of (or in addition to) forming the reflux stream 162 from a portion of the first liquefied natural gas stream 160 in the manner described above, the reflux stream could be from a portion of the liquid phase separated in the LP phase separator 147 by withdrawing a first portion of said liquid phase from the LP phase separator 147 as the first liquefied natural gas stream 160 and withdrawing a second portion of said liquid phase from the LP phase separator 147 as the reflux stream 162 (the first liquefied natural gas stream 160 and the reflux stream 162 being therefore withdrawn from the LP phase separator 147 as separate streams).

A second portion 166 of the first liquefied natural gas stream 160, consisting of the remainder of said stream, is flashed alongside a second set of liquefied natural gas streams 177, 186 and a third liquefied natural gas stream 199 to form a LNG product stream 192 and flash gas streams 171 and 181.

More specifically, the second portion of the first liquefied natural gas stream 160 forms stream 166 that is flashed across a J-T valve and introduced into a HP flash gas phase separator 167 where it is separated into vapor and liquid phases. The HP flash gas phase separator 167 operates at a pressure of 20 to 10 bara. A hydraulic turbine (not shown) can be used to extract work from stream 166 before it flashed and introduced into the HP flash gas phase separator 167. The vapor phase withdrawn from the HP flash gas phase separator 167 forms a first flash gas stream 169, and the liquid phase withdrawn from the HP flash gas phase separator 167 forms liquid stream 168 that is flashed across a J-T valve and introduced into a LP flash gas phase separator 178 where it is separated into vapor and liquid phases. The LP flash gas phase separator 178 operates at a pressure of 10 to 2 bara. The vapor phase withdrawn from the LP flash gas phase separator 178 forms a second flash gas stream 179, and the liquid phase withdrawn from the LP flash gas phase separator 178 forms the LNG product stream 192, which is sent to and stored in a LNG storage tank 193. An LNG pump (not shown) may be used to transfer the LNG product stream 192 to the LNG storage tank 193 if the pressure in the LP flash gas phase separator 178 does not provide enough driving force.

The first flash gas stream 169 is passed through and warmed in the cold side of first 170A and second 170B heat exchanger sections of a first flash gas heat exchanger, forming a warmed first flash gas stream 171. The second flash gas stream 179 is passed through and warmed in the cold side of first 180A and second 180B heat exchanger sections of a second flash gas heat exchanger, forming a warmed second flash gas stream 181.

Figure 1A:
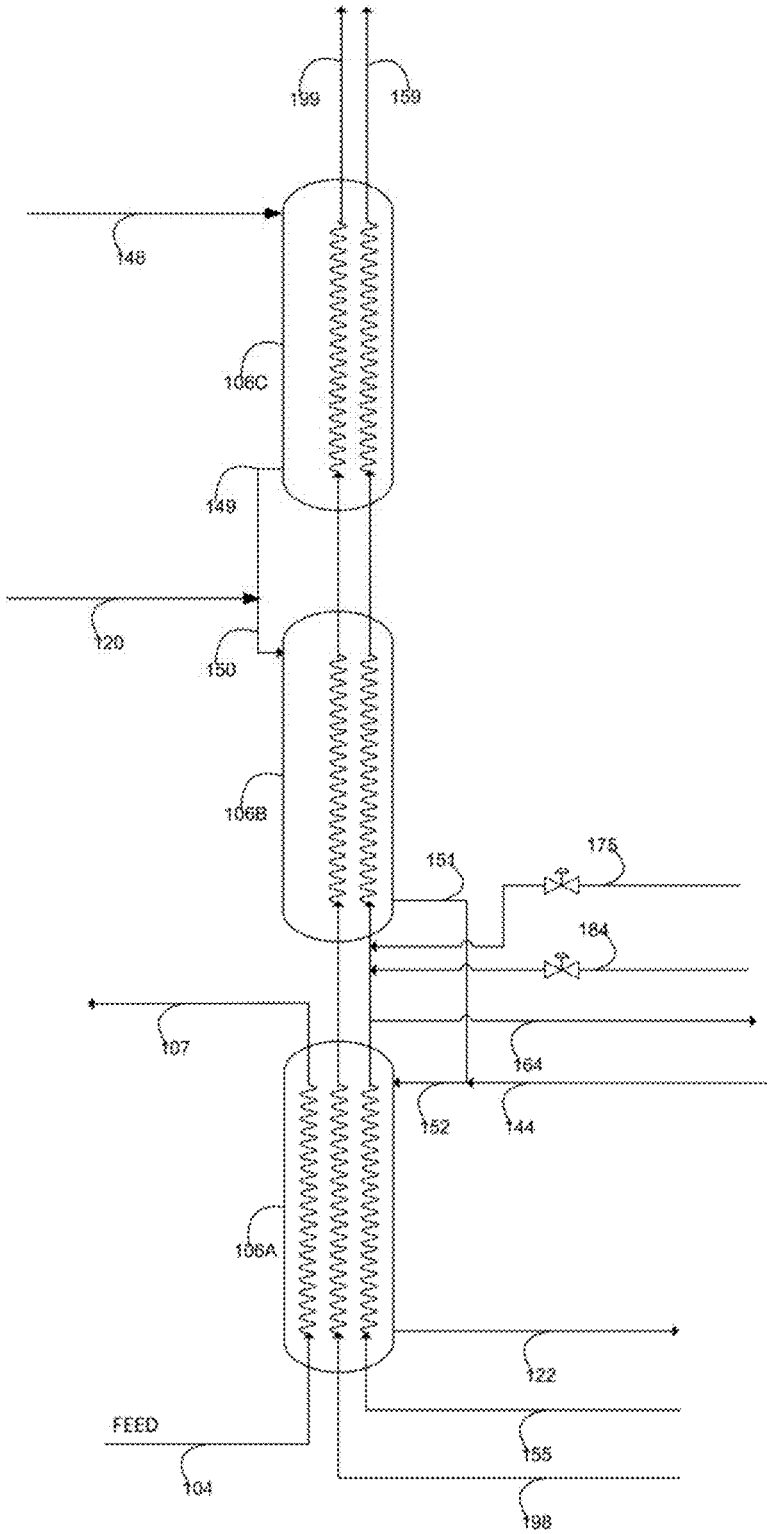
FIG. 1A is a schematic flow diagram depicting coil-wound heat exchanger units suitable for use in the method and system of FIG. 1.

The warmed first and second flash gas streams 171 and 181 are combined and compressed to form a compressed flash gas stream 189. In the embodiment illustrated in FIG. 1 warmed first and second flash gas streams 171 and 181 are compressed in a multi-stage flash gas compressor 187 and an associated aftercooler 188. In the illustrated embodiment, the multi-stage flash gas compressor 187 has five stages with four intercoolers, although the number of stages may be reduced (or increased) depending on the compressor design. The warmed second flash gas stream 181 is routed to the inlet of stage 1 of the multi-stage flash gas compressor 187. The warmed first flash gas stream 171 is in the illustrated embodiment routed to the inlet of stage 3 of the multi-stage flash gas compressor 187, although this stream may be routed to an earlier or later stage of the flash gas compressor 187 depending on where is most efficient. The stages of the multi-stage flash gas compressor 187 can be arranged in any suitable arrangement, two such arrangements being illustrated in FIGS. 10 and 1D.

A boil-off gas (BOG) stream 194, consisting of tank flash, boil-off gas, and vapor displacement, is withdrawn from the headspace of the LNG storage tank 193 and compressed and cooled in a BOG compressor 195 and associated aftercooler 196 to form a compressed BOG gas stream 197. Alternatively, depending on preferred operation, the LNG storage tank 193 may be operated at bubble point. In this case, the BOG stream 194 and associated BOG compressor 195 and associated aftercooler 196 may be eliminated, or the BOG stream 194 may consist only of vapor displacement with the BOG compressor 195 and associated aftercooler 196 being sized accordingly.

The compressed flash gas stream 189, 191 is combined with the compressed BOG gas stream 197 (when present) to form a recycle stream 198 that is passed through and cooled and liquefied the warm side of the first second and third heat exchanger sections 106A, 106B, 106C of the main heat exchanger to form the third liquefied natural gas stream 199 that is flashed across a J-T valve and introduced into the HP flash gas phase separator 167 where it is separated into vapor and liquid phases.

In an alternative embodiment, instead of being combined and then passed through the warm side of the first second and third heat exchanger sections 106A, 106B, 106C as a combined recycle stream 198, the compressed flash gas stream 189, 191 and the compressed BOG gas stream 197 may be passed through separate circuits in the warm side of the first second and third heat exchanger sections 106A, 106B, 106C to be cooled and liquefied separately before being combined. Additionally or alternatively, the cooled and liquefied compressed flash gas stream and compressed BOG gas stream (whether cooled and liquefied separately or as a combined stream) may be routed to and introduced into the LP phase separator 147 (and thus combined and separated with the first cold refrigerant stream 159 and the second cold refrigerant stream 164) to be separated into vapor and liquid phases, instead of being routed to and separated in the HP flash gas phase separator 167.

The refrigerant compressor 124, flash gas compressor 187, and (when present) BOG compressor 197 can be powered via any suitable means. In the embodiment illustrated in FIG. 1, a portion of the compressed flash gas is withdrawn from the compressed flash gas stream 189 is withdrawn to form a fuel stream 190 (prior to the compressed flash gas stream 189 being combined with the compressed BOG stream 197), which fuel stream can be used to power gas turbines used to drive said compressors directly and/or for the generation of electricity used to drive said compressors. Alternatively, where power is available from off-site (such as for example from an electrical grid) this may be used power the compressors, in which case there may be no need for an additional fuel and fuel stream 190 may be eliminated.

Streams 173 and 182, together representing fourth and fifth portions of the compressed refrigerant 142, are cooled in the first and second flash gas heat exchangers via indirect heat exchange with the first and second flash gas streams.

More specifically, stream 173, representing part of the fourth and fifth portions of the compressed refrigerant is passed through and cooled in the warm side of the first heat exchanger section 170A of the first flash gas heat exchanger forming a precooled stream 174 that is then divided into stream 175 and stream 176. Stream 182, representing the other part of the fourth and fifth portions of the compressed refrigerant is passed through and cooled in the warm side of the first heat exchanger section 180A of the second flash gas heat exchanger forming a precooled stream 183 that is then divided into stream 184 and stream 185.

Streams 176 and 185 together represent the fourth portion of the compressed refrigerant. Stream 176 is passed through and further cooled and liquefied in the warm side of the second heat exchanger section 170B of the first flash gas heat exchanger, forming stream 177 of the second set of liquefied natural gas streams which stream is at a temperature of between −130° C. and −100° C. and more preferably between −120° C. and −110° C. and is flashed across a J-T valve and introduced into the HP flash gas phase separator 167 where it is separated into vapor and liquid phases. Stream 185 is passed through and further cooled and liquefied in the warm side of the second heat exchanger section 180B of the second flash gas heat exchanger, forming stream 186 of the second set of liquefied natural gas streams which stream is at a temperature of between −160° C. and −120° C. and more preferably between −150° C. and −130° C. and is flashed across a J-T valve and introduced into the LP flash gas phase separator 178 where it is separated into vapor and liquid phases.

Stream 175 and 184, which together represent the fifth portion of the compressed refrigerant are combined with stream 158 comprising the first portion of the compressed refrigerant prior to said stream being introduced into and passed through the warm side of the second heat exchanger section 106B of the main heat exchanger. In an alternative embodiment, streams 175 and 184 could be combined with the stream 158 after it has been passed through and cooled in the warm side of the second heat exchanger section 106B and prior to said stream being introduced into and passed through the warm side of the third heat exchanger section 106C of the main heat exchanger. Stream 175 consists of between 60 and percent and more preferably between 50 and 30 percent of the flow of precooled stream 174 exiting heat exchanger section 170A. Stream 184 consists of between 60 and 20 percent and more preferably between 50 and 30 percent of the precooled stream 183 exiting Exchanger 180A.

Stream 155, representing the first and second portions of the compressed refrigerant 142, preferably consists of between 50 and 60 percent of the flow of the compressed refrigerant 142. Stream 143, representing the third portion of the compressed refrigerant 142, preferably consists of between 30 and 40 percent of the flow of the compressed refrigerant 142. Streams 173 and 182, that each represent part of the fourth and fifth portions of the compressed refrigerant 142, each preferably consist of between 2 and 10 percent of the flow of the compressed refrigerant 142.

The first 106A, second 106B and third 106C first heat exchanger sections of the main heat exchanger may be heat exchanger sections of any type. In a preferred arrangement all three heat exchanger sections may be coil-wound heat exchanger sections, as for example illustrated in FIG. 1A. However, one, two or all three sections may also be heat exchanger sections of another type, such as for example heat exchanger sections of the shell and tube or plate fin type. The first 106A, second 106B and third 106C first heat exchanger sections may be housed in separate units (such as for example illustrated in FIG. 1A where first 106A, second 106B and third 106C first heat exchanger sections are each coil-wound heat exchanger sections that are each housed in their own shell casing), or alternatively one, two or all three sections could be housed in the same unit (such as for example where first 106A, second 106B and third 106C first heat exchanger sections are each coil-wound heat exchanger sections and two or all three sections are house in the same shell casing). In addition, the main heat exchanger could in alternative embodiments comprise more (or fewer) heat exchanger sections, with additional heat exchanger sections being arranged with in series or parallel with the first 106A, second 106B and third 106C first heat exchanger sections. For example, in one embodiment, the first heat exchanger section 106A could be replaced with a set of (i.e. two or more) first heat exchanger sections arranged in parallel, all of which connect in series to the second heat exchanger section 106B, with the streams that being warmed and cooled in the set of first heat exchanger sections being divided between said sections before being recombined.

In those embodiments where the first 106A, second 106B and third 106C heat exchanger sections of the main heat exchanger are heat exchanger sections of a type where the cold side of the heat exchanger sections can readily accommodate separate streams (such as for example heat exchanger sections of the plate fin type), the natural gas vapor stream, first expanded refrigerant stream and/or second expanded refrigerant stream need not be combined before being cooled, and can instead be cooled in separate circuits in the cold sides of the heat exchanger sections of the main heat exchanger before being combined prior to, during or after compression to form the compressed refrigerant 142.

Figure 1B:
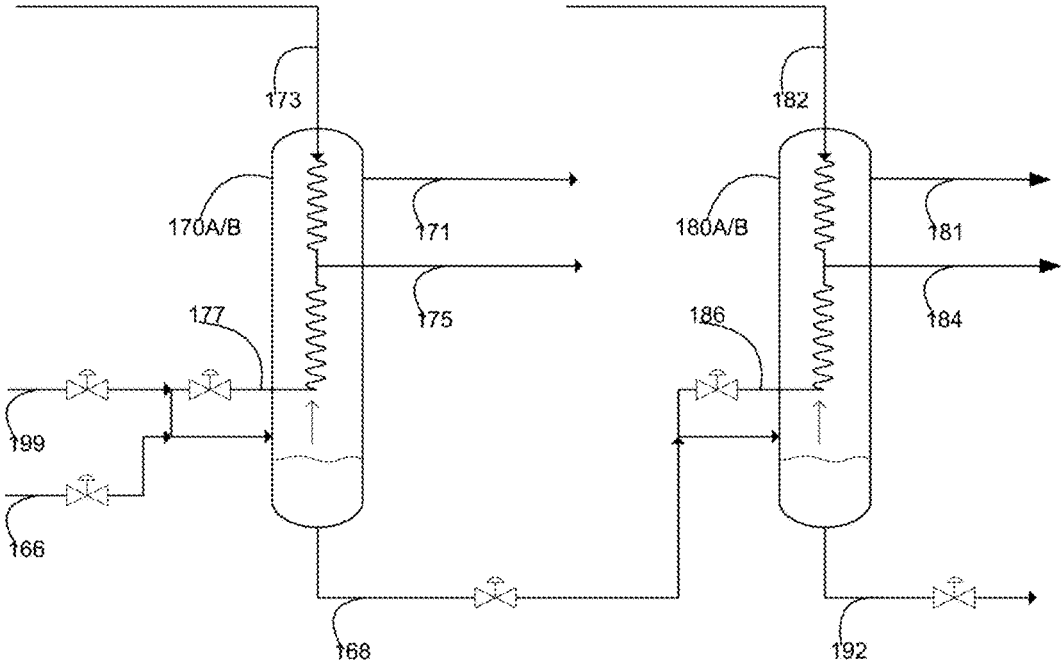
FIG. 1B is a schematic flow diagram depicting integrated heat exchanger and phase separators units suitable for use in the method and system of FIG. 1.
Figure 1C:
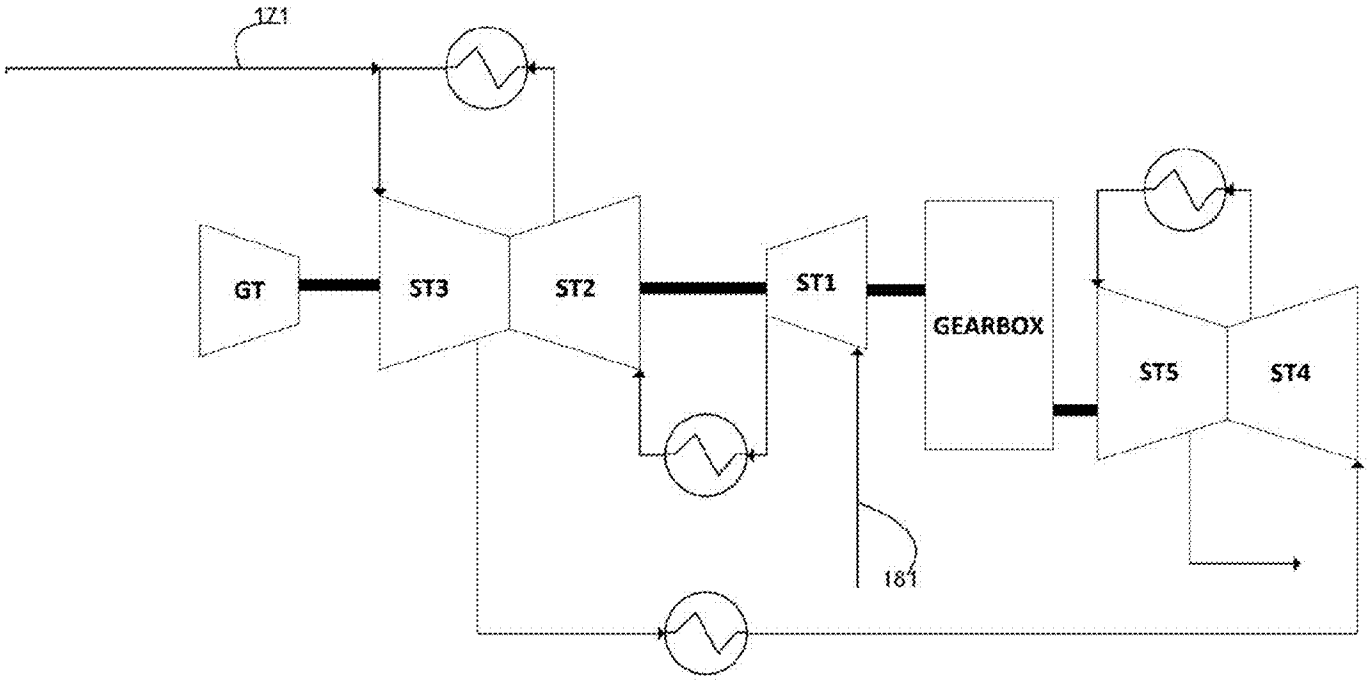
FIG. 1D is a schematic flow diagram depicting another flash gas compressor arrangement suitable for use in the method and system of FIG. 1
Figure 1D:
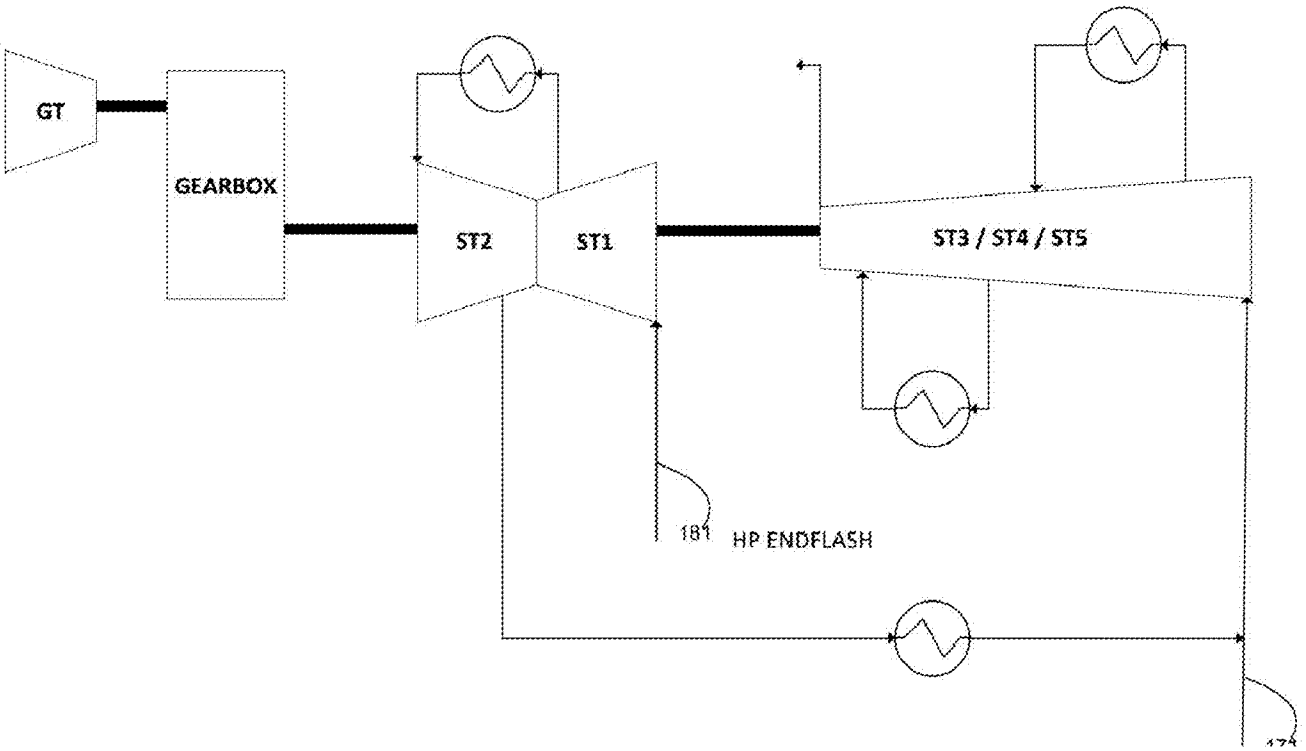

The first 170A and second 170B heat exchanger sections of the first flash gas heat exchanger and the first 180A and second 180B heat exchanger sections of the second flash gas heat exchanger may also be heat exchanger sections of any type. In a preferred arrangement the heat exchanger sections may be coil-wound heat exchanger sections, some or all of the heat exchanger sections may also be heat exchanger sections of another type, such as for example heat exchanger sections of the shell and tube or plate fin type. The first 170A and second 170B heat exchanger sections of the first flash gas heat exchanger may be housed in a single unit (e.g. within the same shell casing in the case where they are coil-wound heat exchanger sections) or in separate units. Likewise, the first 180A and second 180B heat exchanger sections of the second flash gas heat exchanger may be housed in a single unit or in separate units. In alternative embodiments, the first flash gas heat exchanger and/or the second flash gas heat exchanger could consist of more (or fewer) heat exchanger sections.

Where the flash gas heat exchanger and the second flash gas heat exchanger are coil-wound heat exchangers, it is also possible to integrate these heat exchangers with the HP and LP flash gas phase separators, such as is illustrated in shown in FIG. 1B. In this arrangement, the first flash gas heat exchanger unit has a shell casing containing both the first and second heat exchanger sections 170A and 170B precooling and liquefaction sections and a phase separator section that is located below said heat exchanger sections that functions as the HP flash gas phase separator; and the second flash gas heat exchanger unit has a shell casing containing both the first and second heat exchanger sections 180A and 180B precooling and liquefaction sections and a phase separator section that is located below said heat exchanger sections that functions as the LP flash gas phase separator. The first liquefied natural gas stream 166, stream 177 of second set of liquefied natural gas streams, and the third liquefied natural gas stream 199 are all introduced (after being flashed across J-T valves) into the phase separator section of the first flash gas heat exchanger unit where they are separated into a liquid phase and a vapor phase, the liquid phase being withdrawn from the bottom of the first flash gas heat exchanger unit to form liquid stream 168, and the vapor phase forming the first flash gas stream that rises through the shell side of the second 170B and first heat exchanger sections 170A providing the cooling duty to said heat exchanger sections. The liquid stream 168 from the HP flash gas phase separator and stream 186 of second set of liquefied natural gas streams are introduced after being flashed across J-T valves) into the phase separator of the second flash gas heat exchanger unit where they are separated into a liquid phase and a vapor phase, the liquid phase being withdrawn from the bottom of the first flash gas heat exchanger unit to form the LNG product stream 192, and the vapor phase forming the second flash gas stream that rises through the shell side of the second 180B and first heat exchanger sections 180A providing the cooling duty to said heat exchanger sections.

In the embodiment shown in FIG. 1 the first liquefied natural gas stream 166, stream 177 of second set of liquefied natural gas streams, and the third liquefied natural gas stream 199 are all introduced into HP flash gas phase separator 167 where they are combined and separated into vapor and liquid phases as described above. However, in alternative embodiments, one, two or all three streams could be combined after being expanded but before being introduced into the HP flash gas phase separator 167. Alternatively, more than one HP flash gas phase separator could be used, with two or all three streams being introduced into and separated in different HP flash gas phase separators with the vapor phases of the separators being then withdrawn and combined and the liquid phases of the separators being then withdrawn and combined.

Similarly, in the embodiment shown in FIG. 1 the liquid stream 168 from the HP flash gas phase separator and stream 186 of second set of liquefied natural gas streams are introduced into LP flash gas phase separator 178 where they are combined and separated into vapor and liquid phases as described above. However, in alternative embodiments, these streams could be combined after being expanded but before being introduced into the LP flash gas phase separator 178, or two LP flash gas phase separators could be used with the two streams being introduced into and separated in different LP flash gas phase separators with the vapor phases of the separators being then withdrawn and combined and the liquid phases of the separators being then withdrawn and combined.

As described above, in the arrangement shown in FIG. 1 the reflux stream 162 is formed from a portion of the first liquefied natural gas stream 160 by dividing the first liquefied natural gas stream 160 (or can alternatively be formed from a portion of the liquid phase separated in the LP phase separator 147 by withdrawing a portion of said liquid phase from the LP phase separator 147 as the reflux stream 162). However, in alternative embodiments the reflux stream 162 could alternatively (or additionally) be formed from:

(i) a portion of the first cold refrigerant stream 159 withdrawn from said stream prior to said stream being expanded and introduced in the LP phase separator 147;

(ii) a portion of stream 158 (that comprises the first portion of the compressed refrigerant) withdrawn from said stream after said stream has been passed through and cooled in the warm side of the second heat exchanger section 106B of the main heat exchanger and prior to said stream being passed through and further cooled in the warm side of the third heat exchanger section 106C of the main heat exchanger;

(iii) a portion of the liquid separated in the HP flash gas phase separator 167 (said portion being withdrawn as a separate stream from the liquid stream 168 withdrawn from said separator);

(iv) a portion of liquid stream 168 exiting the HP flash gas phase separator 167, said portion of the liquid stream 168 being withdrawn prior to the remainder of said stream being flashed and introduced into the LP flash gas separator 178;

(v) a portion of the liquid separated in the LP flash gas phase separator 178 (said portion being withdrawn as a separate stream from the LNG product stream 192 withdrawn from said separator);

(vi) a portion of the LNG product stream 192 withdrawn prior to the remainder of said stream being transferred to the LNG storage tank 193; and/or (vii) LNG product withdrawn from the LNG storage tank 193.

In an alternative arrangement to that shown in FIG. 1, the first cold refrigerant stream 159 could, instead of being expanded and introduced into the LP phase separator 147 as shown in FIG. 1, be flashed and introduced into the HP flash gas phase separator 167.

In an alternative arrangement to that shown in FIG. 1, the natural gas vapor stream 120, that is formed of distillation column overhead vapor withdrawn from the top of the distillation column, may be combined with the first expanded refrigerant stream 148 that is then passed through the cold side of a third heat exchanger section 106C of the main heat exchanger, instead of being combined with the first expanded refrigerant stream 149 exiting the cold side of the third heat exchanger section 106C of the main heat exchanger.

In an alternative arrangement to that shown in FIG. 1, instead of or in addition to further cooling the first liquefied natural gas stream 166 by flashing said stream to form the LNG product stream 192, the first liquefied natural gas stream 166 may be further cooled against another refrigerant, such as a refrigerant circulating in a closed loop cycle.

The method and system according to the first embodiment of the invention depicted in FIG. 1 provides for various benefits over the method and system depicted in US 2018/0180354 A1.

In particular, the use of distillation column 117 to separate the natural gas feed stream, with the natural gas feed stream being introduced into the distillation column 117 below at least one separation section (117A) thereof, provides for improved recovery of NGLs and aromatics as compared to the use of only a phase separator or stripping column (i.e. a distillation column having no reflux stream and no separation stages above the location at which the natural gas feed stream is introduced into the distillation column). The use of only a phase separator results in poor recovery of NGLs and aromatics from the natural gas feed. Since NGLs are a high value commodity, their loss into the LNG Product is financially inefficient, and where the natural gas feed has a high aromatics content inadequate removal of the aromatics will result in freeze-out of these components in the main heat exchanger and thus a stoppage in operation. The use of only a stripping column may achieve higher NGL recovery than the use of a phase separator but may still leave the natural gas feed with a high content of aromatics. Conversely, by using, in the manner shown in FIG. 1, a distillation column 117 with at least one separation section (117A) above the location at which the natural gas feed is introduced, it is possible to achieve high NGL recovery (i.e. a greater than 90 mol % recovery of C3+ components) while reducing the content of aromatics in the LNG product to less than 1 ppm mol, even for natural gas feeds that have a high starting content of aromatics (thus providing similar levels of performance to those achievable using standalone front-end NGL unit).

The use (in the manner illustrated in FIG. 1) of a main heat exchanger having second and third heat exchanger sections 106B and 106C with the natural gas vapor stream 120 from the top of the distillation column being mixed with the expanded refrigerant stream 149 exiting the cold side of the third heat exchanger section 106C decreases the specific power of the process.

Producing the LNG product by flashing the liquefied natural gas stream 166 obtained from the LP phase separator 147, with associated recovery of cold from the flash gas in flash gas heat exchangers and recycling of the flash gas, also improves the efficiency of the process (by reducing the amount of cooling that needs to be provided in the main heat exchanger).

Using the first heat exchanger section 106A of the main heat exchanger to precool the natural gas feed stream 102 prior to said stream being expanded and separated eliminates the need for separate heat exchanger units for precooling the natural gas feed stream, thereby simplifying the design and reducing plot space. In addition, the use of HP phase separator 110 to then separate the precooled natural gas feed stream into liquid and vapor phases, with the vapor phase being expanded in first expander 112A and the liquid phase being expanded across a J-T valve before the introduction of the precooled natural gas feed stream into the distillation column 117, improves expander efficiency and simplifies expander design as compared to using an expander designed to expand or produce a stream having both liquid and vapor phases (the use of the HP phase separator 110 also adding another theoretical stage of separation and thus further improving NGL recovery).

The combination of the natural gas vapor stream 120 and first expanded refrigerant stream 149 to form the combined stream 150 that is warmed in the cold side of the second heat exchanger section 106B of the main heat exchanger, and the further combination of said combined stream 150 with the second expanded refrigerant stream 144 to form the combined stream 152 that is further warmed in the cold side of the first heat exchanger 106A of the main heat exchanger, means that the refrigerant compressor 124 has to deal with only one inlet stream 122 (formed of the combined and warmed natural gas vapor, first expanded refrigerant and second expanded refrigerant streams), thereby allowing the design of the refrigerant compressor 124 to be significantly simplified. Moreover, it allows the first and second heat exchanger sections 106A and 106B to be coil wound heat exchanger sections, since they then do not have to receive streams that need to be kept separate on the cold side of said heat exchanger sections. As noted above, coil wound heat exchangers are a compact design of heat exchanger known for their robustness, safety, and heat transfer efficiency, and thus have the benefit of providing highly efficient levels of heat exchange relative to their footprint. However, because the shell side defines only a single passage through the heat exchanger section it is not possible use more than one stream of refrigerant in the shell side of the coil wound heat exchanger section without said streams of refrigerant mixing in the shell side of said heat exchanger section.

The operation of the first expander 112A and first compression stage 112B as respectively the expander and compressor portions of a first compander, the second expander 134A and second compression stage 134B as respectively the expander and compressor portions of a second compander, and the third expander 138A and third compression stage 138B as respectively the expander and compressor portions of a third compander, with the outlet of the multi-stage refrigerant compressor 124 connecting to and feeding into the inlets of the compressor portions, also provides additional efficiency.

Figure 2:
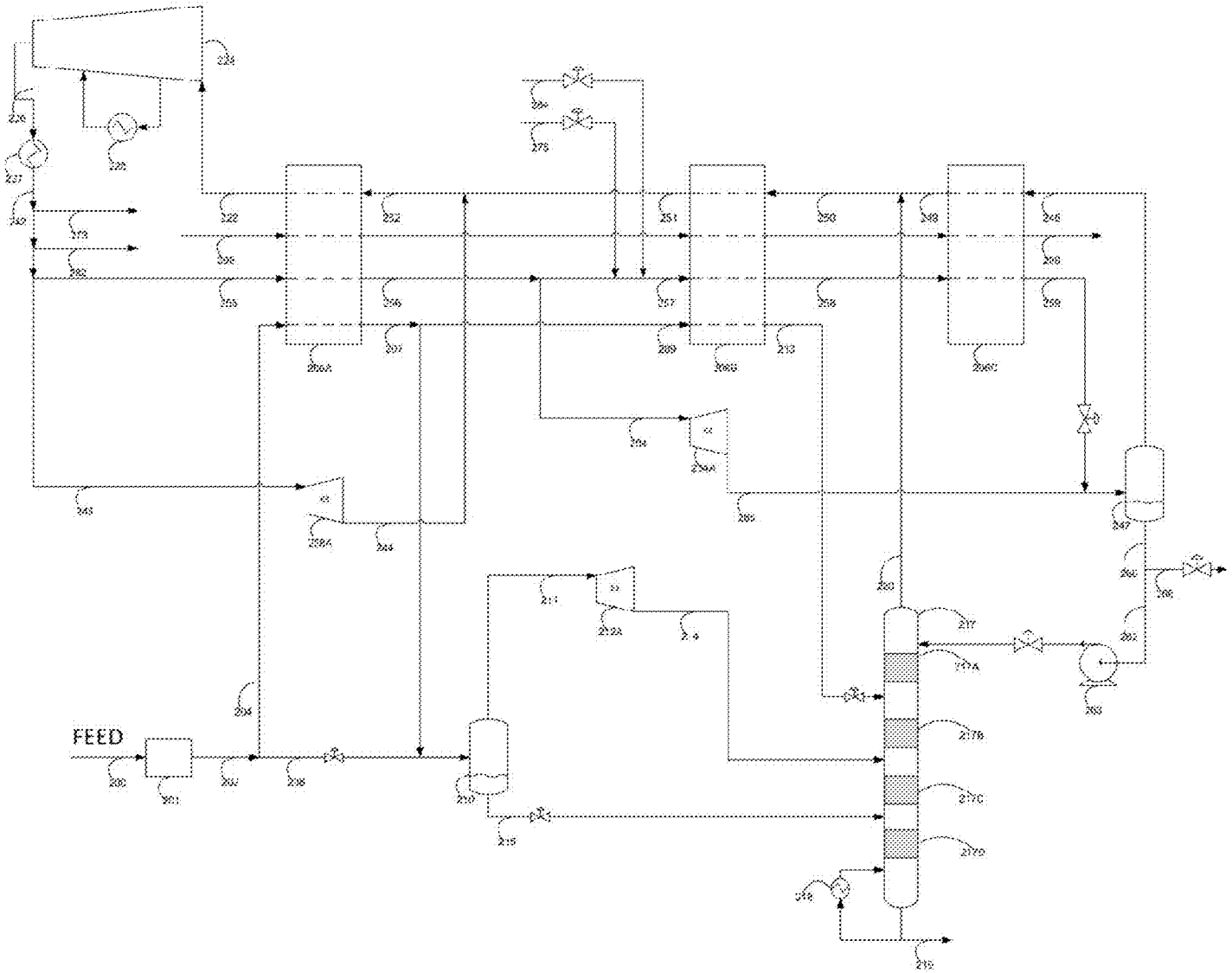
FIG. 2 is a schematic flow diagram depicting a method and system for removing NGLs from and liquefying a natural gas feed stream according to a second embodiment of the present invention.

Referring now to FIG. 2, a method and system for removing NGLs from and liquefying a natural gas feed stream in accordance with a second embodiment of the present invention is shown. In FIG. 2, the equipment and streams downstream of the LP phase separator 247 are not shown, since these are identical to those in FIG. 1. Also, for the sake of simplicity, in arrangement depicted in FIG. 2 the first, second and third expanders 212A, 234A, 238A are not expander portions of companders, the parallel compression stages 112B, 134B and 138B being omitted and all the compression for generation of the compressed refrigerant 242 being provided by the multi-stage refrigerant compressor 224.

The method and system depicted in FIG. 2 differs from that depicted in FIG. 1 in that not all of the precooled feed stream 207 exiting the first heat exchanger section 206A is recombined with the bypass stream 208 and introduced into the HP phase separator 210. Rather, in the arrangement depicted in FIG. 2 the precooled feed stream 207 exiting the first heat exchanger section 206A is divided, with a portion of the stream (representing between 25 and 2 percent and more preferably between 15 and 5 percent of the flow of the precooled feed stream 207) being further cooled by being passed through a circuit in the warm side of the second heat exchanger section 206A and cooled to from a stream 213 at a temperature of between −90° C. and −60° C. and more preferably between −80° C. and −70° C. that is then expanded and introduced into the distillation column at a third intermediate location above the first intermediate location at which expanded stream 214 is introduced into the distillation column 217, there being a separation section 217B between said third and first intermediate locations.

The use of this additional feed stream 213 to the distillation column 217, cooled in the manner described above, can further improve the NGL recovery and reduce the specific power of the process.

All of the variations, alternative embodiments and alternative arrangements described with reference to the embodiment depicted in FIG. 1 likewise apply to the embodiment depicted in FIG. 2 and the embodiments depicted in the further Figures described below.

Figure 3:
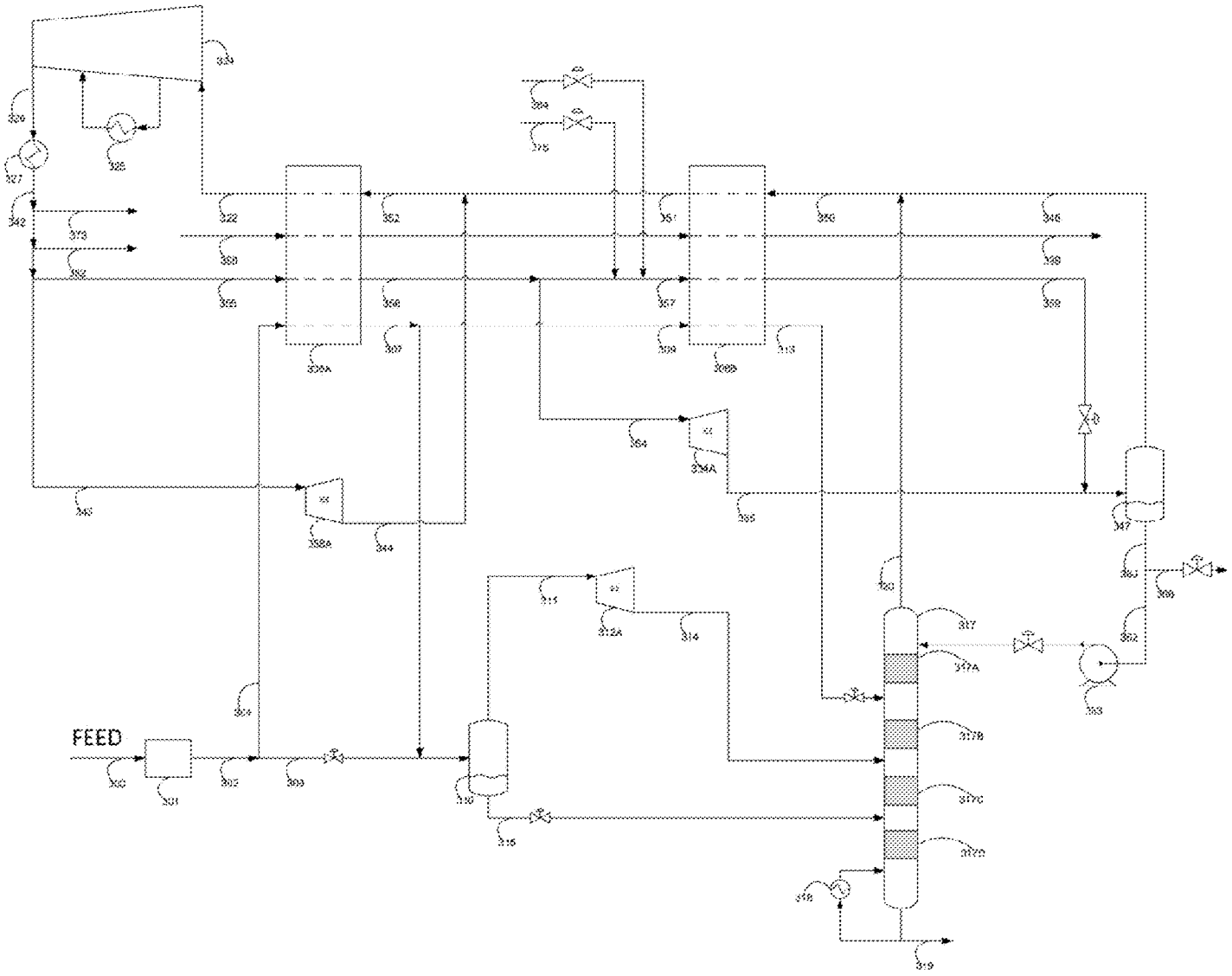
FIG. 3 is a schematic flow diagram depicting a method and system for removing NGLs from and liquefying a natural gas feed stream according to a third embodiment of the present invention.

Referring now to FIG. 3, a method and system for removing NGLs from and liquefying a natural gas feed stream in accordance with a third embodiment of the present invention is shown. In FIG. 3, the equipment and streams downstream of the LP phase separator 347 are not shown, since these are identical to those in FIG. 1. Also, for the sake of simplicity, in arrangement depicted in FIG. 3 the first, second and third expanders 312A, 334A, 338A are not expander portions of companders, the parallel compression stages 112B, 134B and 138B being omitted and all the compression for generation of the compressed refrigerant 342 being provided by the multi-stage refrigerant compressor 324.

The method and system depicted in FIG. 3 differs from that depicted in FIG. 2 in that the third heat exchanger section 206C of the main heat exchanger has been removed and is not used. This reduces equipment count but has a negative impact on the specific power of the process.

Figure 4:
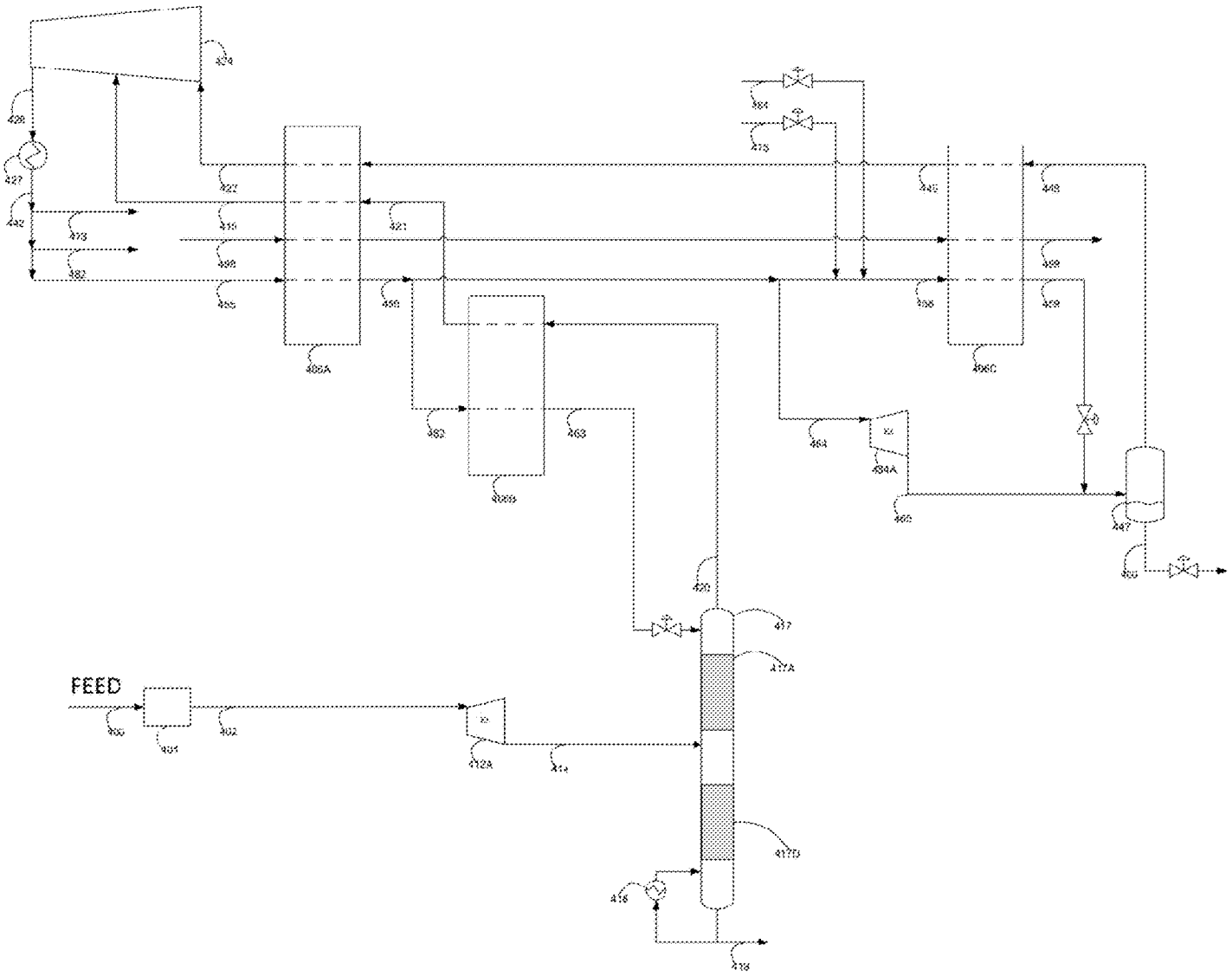
FIG. 4 is a schematic flow diagram depicting a method and system for removing NGLs from and liquefying a natural gas feed stream according to a fourth embodiment of the present invention

Referring now to FIG. 4, a method and system for removing NGLs from and liquefying a natural gas feed stream in accordance with a third embodiment of the present invention is shown. In FIG. 4, the equipment and streams downstream of the LP phase separator 447 are not shown, since these are identical to those in FIG. 1 except where otherwise stated below. Also, for the sake of simplicity, in arrangement depicted in FIG. 4 the first and second expanders 412A, 434A are not expander portions of companders, the parallel compression stages 112B and 134B being omitted and all the compression for generation of the compressed refrigerant 442 being provided by the multi-stage refrigerant compressor 424.

The method and system depicted in FIG. 4 differs from that depicted in FIG. 1 in that the third expander 138A has been removed (there being therefore also no second expanded refrigerant stream 144); the second heat exchanger section 106B of the main heat exchanger has been removed and replaced with an economizer heat exchanger section 406B, with the natural gas vapor stream 420 withdrawn from the top of the distillation column 417 being cooled separately from the first expanded refrigerant stream 449 exiting the cold side of the third heat exchanger section 406C and with the reflux stream 462, 463 to the distillation column 417 being differently sourced; and the HP phase separator 110 has also been removed. This reduces equipment count but has a negative impact on the specific power of the process.

More specifically, in the method and system of FIG. 4, the pretreated natural gas feed stream 402 is expanded in the first expander 412A and introduced into the distillation column 417 at an intermediate location below separation section 417A of the column and above separation section 417D of the column. Natural gas vapor stream 420 withdrawn from the top of the distillation column is passed through and warmed in the cold side of economizer heat exchanger section 406B before being passed through and further warmed in the cold side of the first heat exchanger section 406A, the natural gas vapor stream 421 being passed through a separate circuit in the cold side of the first heat exchanger section 406A than the circuit in the cold side of the first heat exchanger section 406A through which the first expanded refrigerant stream 449 is passed. The warmed first expanded refrigerant stream 422 exiting the cold side of the first heat exchanger section 406A is sent to the low pressure inlet of the multi-stage refrigerant compressor 424, and the warmed natural gas vapor stream 415 exiting the cold side of the first heat exchanger section 406A is sent to a medium pressure inlet of the multi-stage refrigerant compressor 424 where it is combined and further compressed with the first expanded refrigerant. A portion of the cooled stream 456 (comprising the first and second portions of the compressed refrigerant) exiting the warm side of the first heat exchanger section 406 is withdrawn to form the reflux stream 462, and this reflux stream is passed through and further cooled in the warm side of economizer heat exchanger section 406B before being expanded and introduced into the top of the distillation column 417.

Figure 5:
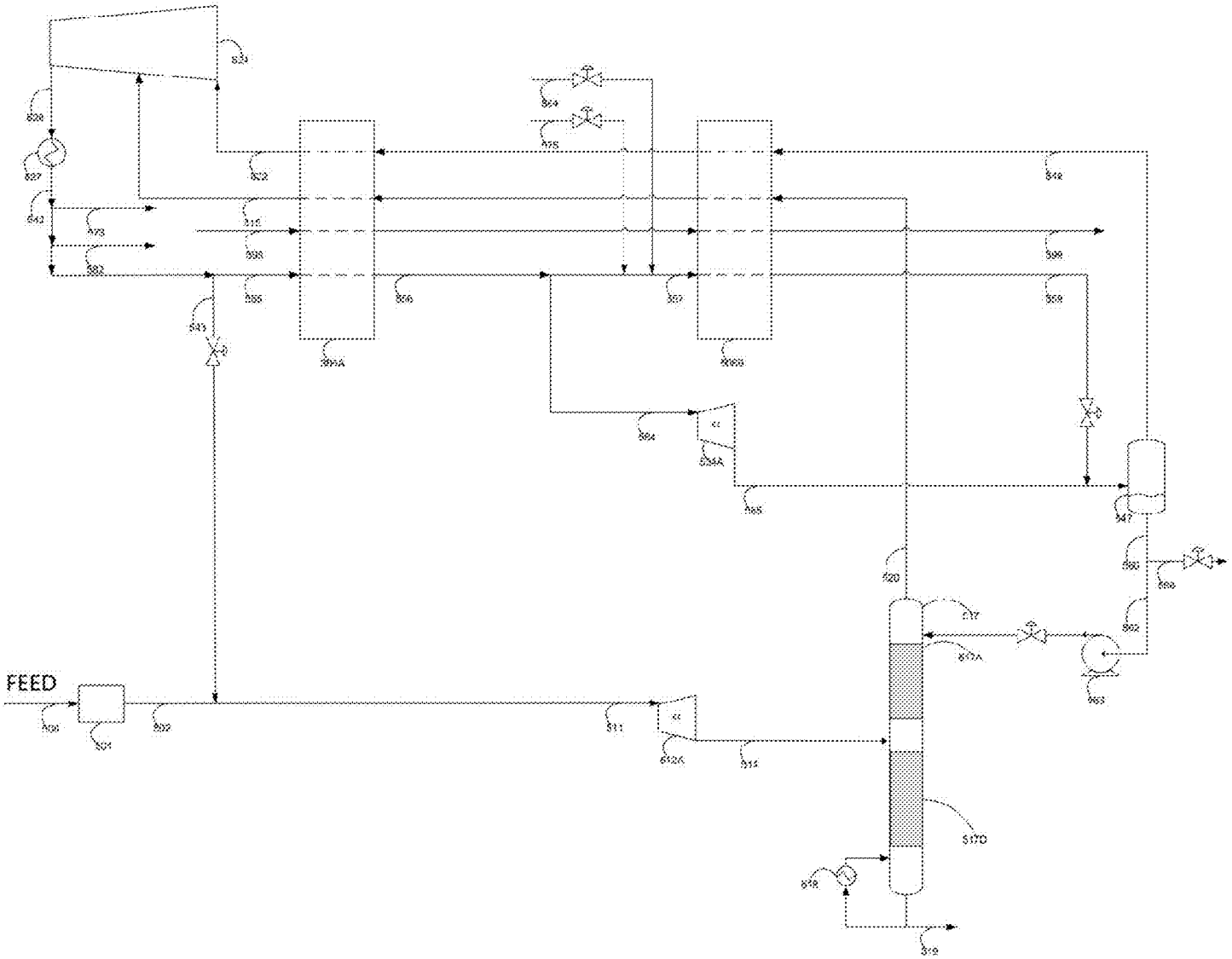
FIG. 5 is a schematic flow diagram depicting a method and system for removing NGLs from and liquefying a natural gas feed stream according to a fifth embodiment of the present invention

Referring now to FIG. 5, a method and system for removing NGLs from and liquefying a natural gas feed stream in accordance with a fifth embodiment of the present invention is shown. In FIG. 5, the equipment and streams downstream of the LP phase separator 547 are not shown, since these are identical to those in FIG. 1 except where otherwise stated below. Also, for the sake of simplicity, in arrangement depicted in FIG. 5 the first and second expanders 512A, 534A are not expander portions of companders, the parallel compression stages 112B and 134B being omitted and all the compression for generation of the compressed refrigerant 542 being provided by the multi-stage refrigerant compressor 524.

The method and system depicted in FIG. 5 differs from that depicted in FIG. 1 in that the third expander 138A has been removed (there being therefore also no second expanded refrigerant stream 144); the third heat exchanger section 106C of the main heat exchanger has been removed; and the HP phase separator 110 has also been removed. This reduces equipment count but has a negative impact on the specific power of the process.

More specifically, in the method and system of FIG. 5, the pretreated natural gas feed stream 502 is expanded in the first expander 512A and introduced into the distillation column 517 at an intermediate location below separation section 517A of the column and above separation section 517D of the column. In the illustrated embodiment, the natural gas vapor stream 520 withdrawn from the top of the distillation column is passed through and warmed in the cold side of the second heat exchanger section 506B before being passed through and further warmed in the cold side of the first heat exchanger section 506A, the natural gas vapor stream 520 being passed through separate circuits in the cold side of the second and first heat exchanger sections 506B and 506A than the circuit in the cold side of said heat exchanger sections through which the first expanded refrigerant stream 548 is passed. The warmed first expanded refrigerant stream 522 exiting the cold side of the first heat exchanger section 506A is then sent to the low pressure inlet of the multi-stage refrigerant compressor 524, and the warmed natural gas vapor stream 515 exiting the cold side of the first heat exchanger section 506A is sent to a medium pressure inlet of the multi-stage refrigerant compressor 524 where it is combined and further compressed with the first expanded refrigerant. In an alternative embodiment, the natural gas vapor stream 520 could be combined with the first expanded refrigerant stream 548 before warming and compression of the combined stream in the same manner shown in FIG. 1, which approach would allow the use of a coil wound heat exchanger sections for the first and second heat exchanger sections 506A and 506B and would simplify the design of the multi-stage refrigerant compressor 524, but which may result in a slight further increase in specific power.

Figure 6:
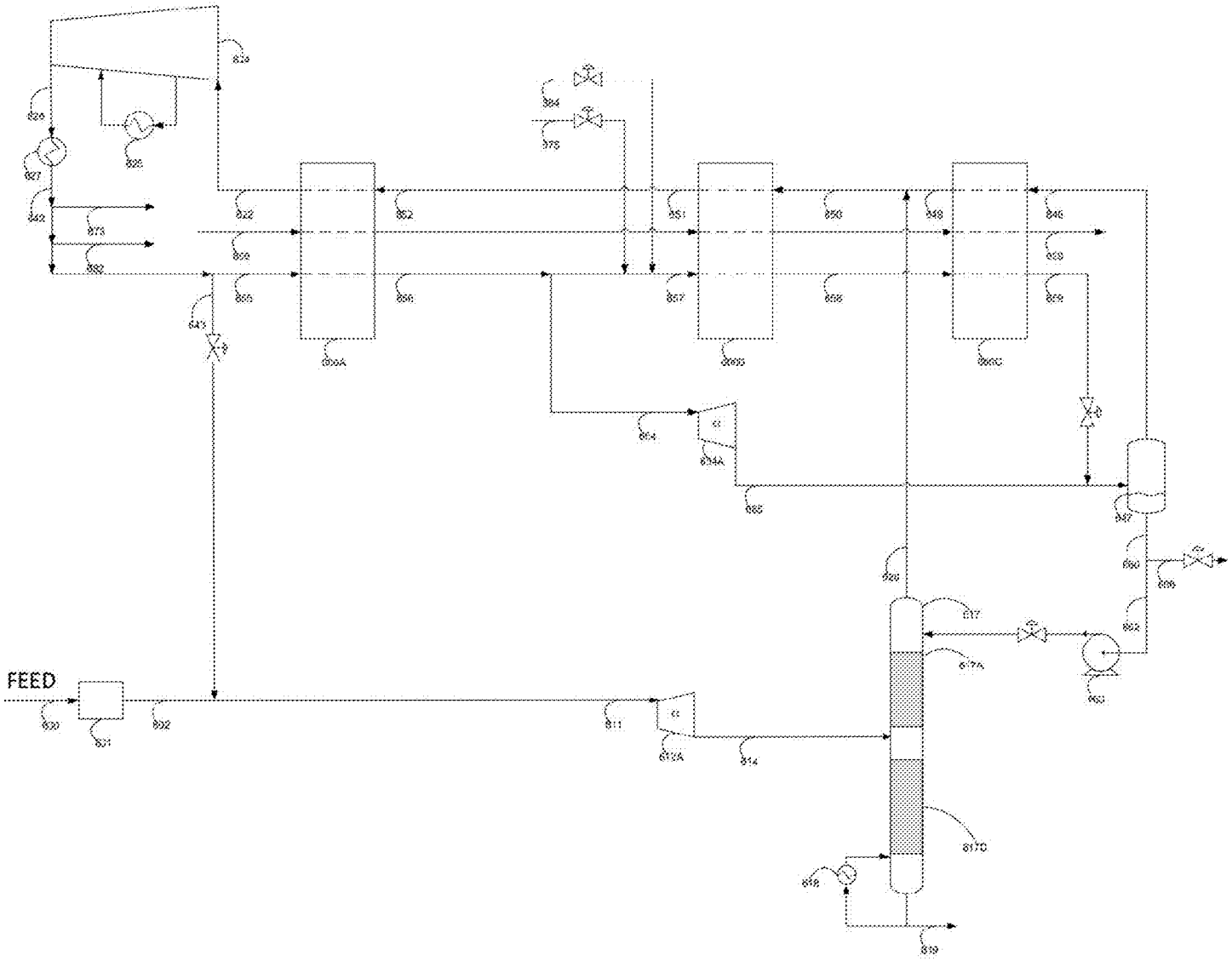
FIG. 6 is a schematic flow diagram depicting a method and system for removing NGLs from and liquefying a natural gas feed stream according to a sixth embodiment of the present invention

Referring now to FIG. 6, a method and system for removing NGLs from and liquefying a natural gas feed stream in accordance with a sixth embodiment of the present invention is shown. In FIG. 6, the equipment and streams downstream of the LP phase separator 647 are not shown, since these are identical to those in FIG. 1 except where otherwise stated below. Also, for the sake of simplicity, in arrangement depicted in FIG. 6 the first and second expanders 612A, 634A are not expander portions of companders, the parallel compression stages 112B and 134B being omitted and all the compression for generation of the compressed refrigerant 642 being provided by the multi-stage refrigerant compressor 624.

The method and system depicted in FIG. 6 differs from that depicted in FIG. 5 in that the third heat exchanger section 606C of the main heat exchanger has been reintroduced, and the natural gas vapor stream 620 is combined with the first expanded refrigerant stream 649 before warming and compression of the combined stream in the same manner shown in FIG. 1. This approach has a better specific power than that shown in FIG. 5.

Figure 7:
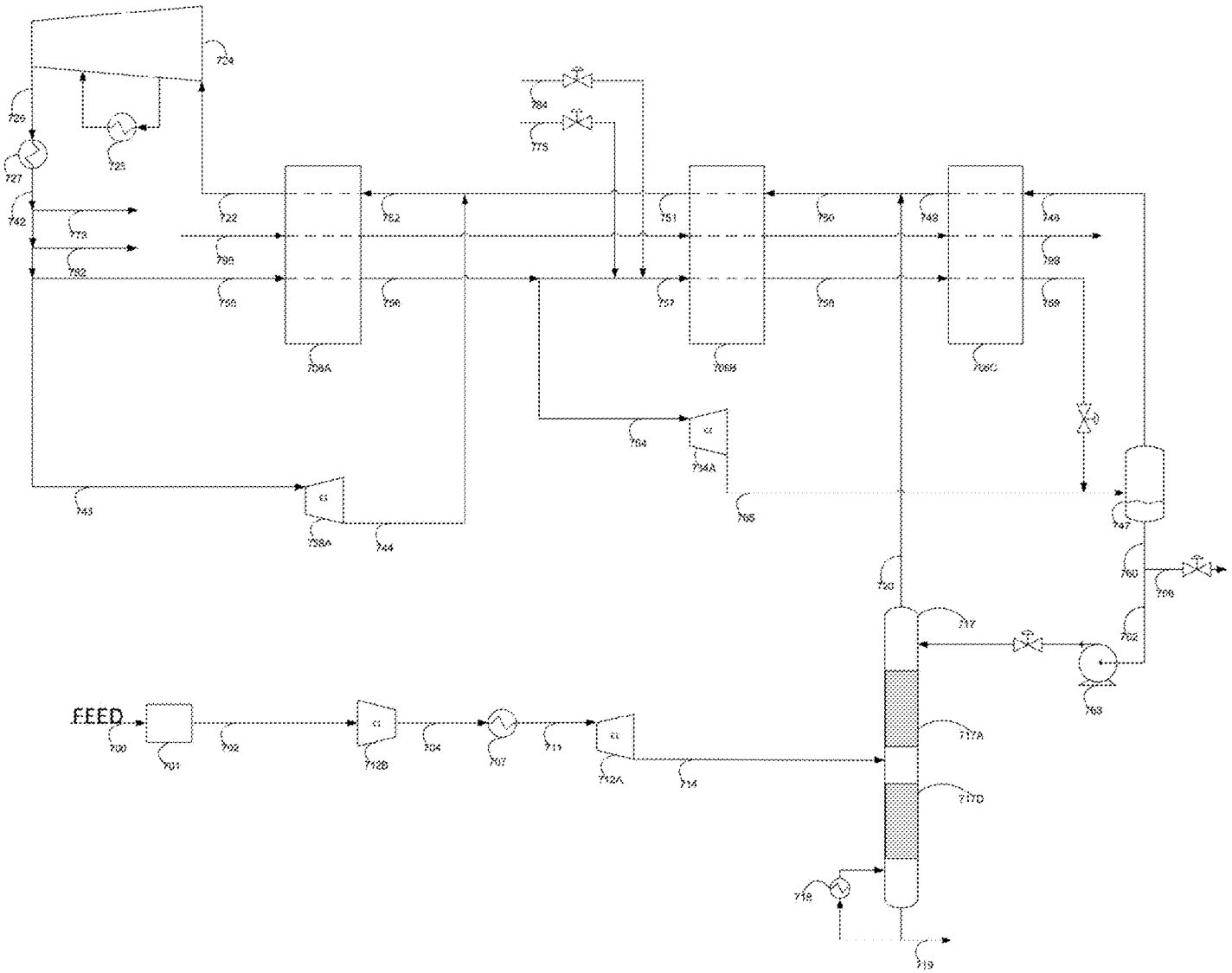
FIG. 7 is a schematic flow diagram depicting a method and system for removing NGLs from and liquefying a natural gas feed stream according to a seventh embodiment of the present invention

Referring now to FIG. 7, a method and system for removing NGLs from and liquefying a natural gas feed stream in accordance with a seventh embodiment of the present invention is shown. In FIG. 7, the equipment and streams downstream of the LP phase separator 747 are not shown, since these are identical to those in FIG. 1. Also, for the sake of simplicity, in arrangement depicted in FIG. 7 the second and third expanders 734A and 738A are not expander portions of companders, the parallel compression stages 712B, 734B and 738B being omitted and all the compression for generation of the compressed refrigerant 742 being provided by the multi-stage refrigerant compressor 724.

The method and system depicted in FIG. 7 differs from that depicted in FIG. 1 in that the HP phase separator 110 has been removed; and the first expander 712B is the expander portion of a compander where the compressor portion of said compressor is used to compress the natural gas feed prior to expansion.

More specifically, in the method and system of FIG. 7, the pretreated natural gas feed stream 702 is first compressed in a feed compression stage 712B constituting the compressor portion of a first compander, and cooled in associated aftercooler 707, before being expanded in the first expander 712A that forms the expander portion of the first compander, and introduced into the distillation column 717 at an intermediate location below separation section 717A of the column and above separation section 717D of the column.

By compressing the natural gas feed stream before expansion, the arrangement depicted in FIG. 7 removes the need to precool the natural gas feed stream in one or more heat exchangers of the main heat exchanger thus simplifying the design of the said exchangers. As compared to the arrangement shown in FIG. 2, the possibility of heavy feed components freezing in the second heat exchanger 706B is also removed. Furthermore, removing the HP Feed Separator 110 and reducing the number of feed streams to the distillation column also simplifies the design of the system. As compared to the arrangement shown in FIG. 2, the arrangement shown in FIG. 7 has a better specific power.

Figure 8:
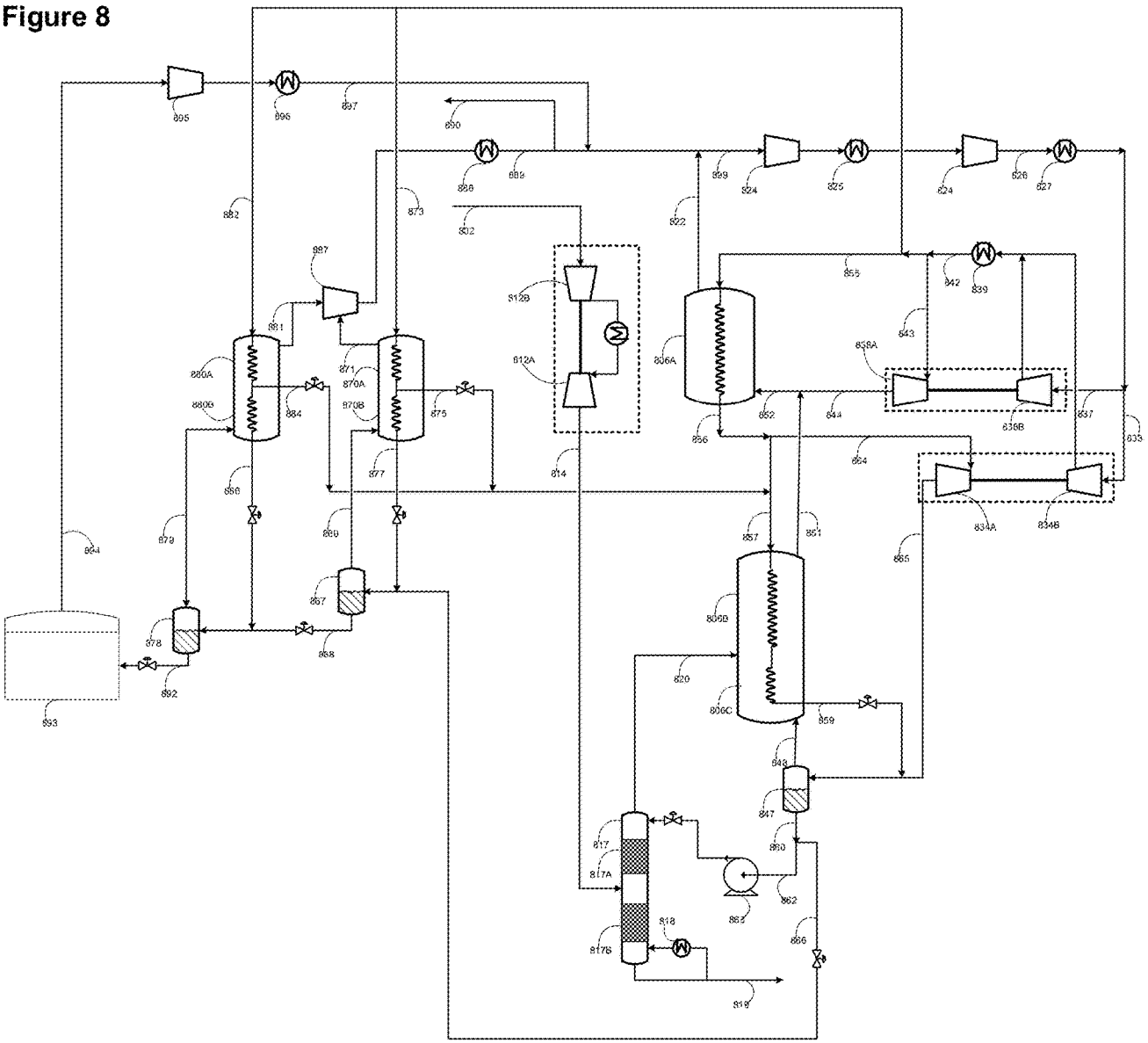
FIG. 8 is a schematic flow diagram depicting a method and system for removing NGLs from and liquefying a natural gas feed stream according to an eighth embodiment of the present invention

Referring now to FIG. 8, a method and system for removing NGLs from and liquefying a natural gas feed stream in accordance with an eighth embodiment of the present invention is shown.

The method and system depicted in FIG. 8 differs from that the compressed BOG gas stream 897 and compressed flash gas stream 889 are not combined to form a recycle stream 198 that is passed through and cooled and liquefied the warm side of the first, second and third heat exchanger sections 106A, 106B, 106C of the main heat exchanger to form the third liquefied natural gas stream 199 that is flashed across a J-T valve and introduced into the HP flash gas phase separator 167. Instead, in the arrangement shown in FIG. 8, the compressed BOG gas stream 897 and compressed flash gas stream 889 are combined with the combined natural gas vapor, first expanded refrigerant and second expanded refrigerant stream 822 exiting the cold side of the first heat exchanger section 806A, with the combined stream 899 of natural gas vapor, first expanded refrigerant, second expanded refrigerant, flash gas and BOG being then sent to the inlet of the multi-stage refrigerant compressor 824.

In a similar manner to the embodiment shown in FIG. 7, in the method and system of FIG. 8 the HP phase separator 110 has also been removed; and the first expander 812B is the expander portion of a compander the compressor portion of which is used to compress the natural gas feed 802 prior to said feed being expanded in the first expander 812B and introduced into the distillation column 817 at an intermediate location below separation section 817A and above separation section 817B of the column. As a result, in the arrangement shown in FIG. 8 the parallel compression stages consist of only two stages 834B and 838B the first stage 112B being eliminated.

In the specific arrangement shown in FIG. 8, the first, second and third heat exchanger sections 806A, 806B, 806C of the main heat exchanger are all coil-wound heat exchanger sections, with the third heat exchanger section 806C being located below the second heat exchanger section 806B (which in turn is located below the first heat exchanger section 806A).

In such an arrangement it would, in an alternative embodiment, be possible to integrate the LP phase separator 847 with the coil wound heat exchanger unit containing the third heat exchanger section 806C (in the particular embodiment illustrated in FIG. 8, the coil wound heat exchanger unit containing the third heat exchanger section contains also the second heat exchanger section 806B). More specifically, in such an arrangement the coil wound heat exchanger unit will have a shell casing containing the third heat exchanger section (and optionally the second or second and first heat exchanger sections above that) and a phase separator section located below the third heat exchanger section. The first cold refrigerant stream and the second cold refrigerant stream are expanded and introduced into the phase separator section of the coil wound heat exchanger unit where they are separated into a liquid phase and a vapor phase the liquid phase being withdrawn from the bottom of the coil wound heat exchanger unit to form the first liquefied natural gas stream, and the vapor phase forming the first expanded refrigerant stream that rises through the shell side of the third heat exchanger section.

Example 1

In this example, a method and system for cooling and liquefying natural gas as depicted in FIG. 1 was simulated, using Aspen simulation software, version 10, available from Aspen Technologies, Inc.

Table 1 shows stream data from a simulated example. In this example, the multi-stage refrigerant compressor 124 had two stages and was operated in two strings with each string having an approximate gas horsepower of 48.8 MW. The flash gas compressor 187 and BOG compressor 195 had an approximate gas horsepower of 36.6 MW and 12.0 MW, respectively. In the simulated process, 90 mole % of C3+ components from the natural gas feed are recovered in the NGL stream 119 withdrawn from the bottom of the distillation column 117.

TABLE 1

| | | Stream # | | | | | |
|---|---|---|---|---|---|---|---|
| | | 102 | 104 | 107 | 108 | 111 | 114 |
| Temperature | ° C. | 30.0 | 30.0 | −32.5 | 30.0 | −9.8 | −63.7 |
| Pressure | bara | 89.6 | 89.6 | 85.2 | 89.6 | 84.9 | 27.5 |
| Vapor Fraction | — | 1.00 | 1.00 | 0.94 | 1.00 | 1.00 | 0.94 |
| Flow | kgmol/hr | 25,052 | 13,787 | 13,787 | 11,265 | 24,607 | 24,607 |
| Composition | mol % | | | | | | |
| N2 | | 2.00 | 2.00 | 2.00 | 2.00 | 2.03 | 2.03 |
| C1 | | 88.05 | 88.05 | 88.05 | 88.05 | 88.84 | 88.84 |
| C2 | | 5.92 | 5.92 | 5.92 | 5.92 | 5.83 | 5.83 |
| C3 | | 2.16 | 2.16 | 2.16 | 2.16 | 2.01 | 2.01 |
| I4 | | 0.36 | 0.36 | 0.36 | 0.36 | 0.31 | 0.31 |
| C4 | | 0.67 | 0.67 | 0.67 | 0.67 | 0.55 | 0.55 |
| I5 | | 0.20 | 0.20 | 0.20 | 0.20 | 0.14 | 0.14 |
| C5 | | 0.20 | 0.20 | 0.20 | 0.20 | 0.13 | 0.13 |
| C6 | | 0.28 | 0.28 | 0.28 | 0.28 | 0.12 | 0.12 |
| BZ | | 0.03 | 0.03 | 0.03 | 0.03 | 0.01 | 0.01 |
| C7 | | 0.09 | 0.09 | 0.09 | 0.09 | 0.02 | 0.02 |
| C8 | | 0.04 | 0.04 | 0.04 | 0.04 | 0.00 | 0.00 |
| CD | | 0.00 | 0.00 | 0.00 | 0.00 | 0.00 | 0.00 |
| Total | | 100.00 | 100.00 | 100.00 | 100.00 | 100.00 | 100.00 |

| | | Stream # | | | | | |
|---|---|---|---|---|---|---|---|
| | | 115 | 119 | 120 | 122 | 126 | 131 |
| Temperature | ° C. | −9.8 | 53.5 | −75.1 | 26.2 | 62.3 | 30.0 |
| Pressure | bara | 84.9 | 28.1 | 27.4 | 26.3 | 57.8 | 89.6 |
| Vapor Fraction | — | 0.00 | 0.00 | 1.00 | 1.00 | 1.00 | 1.00 |
| Flow | kgmol/hr | 445 | 1,361 | 26,121 | 149,639 | 149,639 | 23,958 |
| Composition | mol % | | | | | | |
| N2 | | 0.46 | 0.00 | 2.03 | 3.78 | 3.78 | 3.78 |
| C1 | | 44.12 | 1.58 | 92.94 | 94.40 | 94.40 | 94.40 |
| C2 | | 11.05 | 31.64 | 4.58 | 1.69 | 1.69 | 1.69 |
| C3 | | 10.30 | 32.35 | 0.44 | 0.13 | 0.13 | 0.13 |
| I4 | | 3.13 | 6.63 | 0.00 | 0.00 | 0.00 | 0.00 |
| C4 | | 7.48 | 12.33 | 0.00 | 0.00 | 0.00 | 0.00 |

TABLE 1-continued

| | | | | | | | |
|---|---|---|---|---|---|---|---|
| I5 | | 3.58 | 3.68 | 0.00 | 0.00 | 0.00 | 0.00 |
| C5 | | 4.06 | 3.68 | 0.00 | 0.00 | 0.00 | 0.00 |
| C6 | | 8.93 | 5.16 | 0.00 | 0.00 | 0.00 | 0.00 |
| BZ | | 1.00 | 0.55 | 0.00 | 0.00 | 0.00 | 0.00 |
| C7 | | 3.86 | 1.66 | 0.00 | 0.00 | 0.00 | 0.00 |
| C8 | | 2.05 | 0.74 | 0.00 | 0.00 | 0.00 | 0.00 |
| CD | | 0.01 | 0.01 | 0.00 | 0.00 | 0.00 | 0.00 |
| Total | | 100.00 | 100.00 | 100.00 | 100.00 | 100.00 | 100.00 |

| | | Stream # | | | | | |
|---|---|---|---|---|---|---|---|
| | | 136 | 140 | 143 | 144 | 148 | 149 |
| Temperature | ° C. | 30.0 | 30.0 | 29.9 | −45.4 | −97.0 | −78.6 |
| Pressure | bara | 89.6 | 89.6 | 89.3 | 27.1 | 27.7 | 27.4 |
| Vapor Fraction | — | 1.00 | 1.00 | 1.00 | 1.00 | 1.00 | 1.00 |
| Flow | kgmol/hr | 53,170 | 72,511 | 51,897 | 51,897 | 71,621 | 71,621 |
| Composition | mol % | | | | | | |
| N2 | | 3.78 | 3.78 | 3.78 | 3.78 | 4.41 | 4.41 |
| C1 | | 94.40 | 94.40 | 94.40 | 94.40 | 94.93 | 94.93 |
| C2 | | 1.69 | 1.69 | 1.69 | 1.69 | 0.64 | 0.64 |
| C3 | | 0.13 | 0.13 | 0.13 | 0.13 | 0.01 | 0.01 |
| I4 | | 0.00 | 0.00 | 0.00 | 0.00 | 0.00 | 0.00 |
| C4 | | 0.00 | 0.00 | 0.00 | 0.00 | 0.00 | 0.00 |
| I5 | | 0.00 | 0.00 | 0.00 | 0.00 | 0.00 | 0.00 |
| C5 | | 0.00 | 0.00 | 0.00 | 0.00 | 0.00 | 0.00 |
| C6 | | 0.00 | 0.00 | 0.00 | 0.00 | 0.00 | 0.00 |
| BZ | | 0.00 | 0.00 | 0.00 | 0.00 | 0.00 | 0.00 |
| C7 | | 0.00 | 0.00 | 0.00 | 0.00 | 0.00 | 0.00 |
| C8 | | 0.00 | 0.00 | 0.00 | 0.00 | 0.00 | 0.00 |
| CD | | 0.00 | 0.00 | 0.00 | 0.00 | 0.00 | 0.00 |
| Total | | 100.00 | 100.00 | 100.00 | 100.00 | 100.00 | 100.00 |

| | | Stream # | | | | | |
|---|---|---|---|---|---|---|---|
| | | 150 | 151 | 152 | 155 | 156 | 157 |
| Temperature | ° C. | −77.7 | −39.0 | −41.3 | 30.0 | −32.5 | −30.4 |
| Pressure | bara | 27.4 | 27.1 | 27.0 | 89.5 | 87.1 | 87.1 |
| Vapor Fraction | — | 1.00 | 1.00 | 1.00 | 1.00 | 1.00 | 1.00 |
| Flow | kgmol/hr | 97,742 | 97,742 | 149,639 | 84,765 | 84,765 | 21,808 |
| Composition | mol % | | | | | | |
| N2 | | 3.78 | 3.78 | 3.78 | 3.78 | 3.78 | 3.78 |
| C1 | | 94.40 | 94.40 | 94.40 | 94.40 | 94.40 | 94.40 |
| C2 | | 1.69 | 1.69 | 1.69 | 1.69 | 1.69 | 1.69 |
| C3 | | 0.13 | 0.13 | 0.13 | 0.13 | 0.13 | 0.13 |
| I4 | | 0.00 | 0.00 | 0.00 | 0.00 | 0.00 | 0.00 |
| C4 | | 0.00 | 0.00 | 0.00 | 0.00 | 0.00 | 0.00 |
| I5 | | 0.00 | 0.00 | 0.00 | 0.00 | 0.00 | 0.00 |
| C5 | | 0.00 | 0.00 | 0.00 | 0.00 | 0.00 | 0.00 |
| C6 | | 0.00 | 0.00 | 0.00 | 0.00 | 0.00 | 0.00 |
| BZ | | 0.00 | 0.00 | 0.00 | 0.00 | 0.00 | 0.00 |
| C7 | | 0.00 | 0.00 | 0.00 | 0.00 | 0.00 | 0.00 |
| C8 | | 0.00 | 0.00 | 0.00 | 0.00 | 0.00 | 0.00 |
| CD | | 0.00 | 0.00 | 0.00 | 0.00 | 0.00 | 0.00 |
| Total | | 100.00 | 100.00 | 100.00 | 100.00 | 100.00 | 100.00 |

| | | Stream # | | | | | |
|---|---|---|---|---|---|---|---|
| | | 158 | 159 | 160 | 162 | 164 | 165 |
| Temperature | ° C. | −75.5 | −94.8 | −97.0 | −97.0 | −32.5 | −92.7 |
| Pressure | bara | 85.1 | 78.2 | 27.7 | 27.7 | 87.1 | 27.7 |
| Vapor Fraction | — | 0.00 | 0.00 | 0.00 | 0.00 | 1.00 | 0.98 |
| Flow | kgmol/hr | 21,808 | 21,808 | 18,035 | 2,429 | 67,848 | 67,848 |
| Composition | mol % | | | | | | |
| N2 | | 3.78 | 3.78 | 1.25 | 1.25 | 3.78 | 3.78 |
| C1 | | 94.40 | 94.40 | 92.29 | 92.29 | 94.40 | 94.40 |
| C2 | | 1.69 | 1.69 | 5.87 | 5.87 | 1.69 | 1.69 |
| C3 | | 0.13 | 0.13 | 0.58 | 0.58 | 0.13 | 0.13 |
| I4 | | 0.00 | 0.00 | 0.00 | 0.00 | 0.00 | 0.00 |
| C4 | | 0.00 | 0.00 | 0.00 | 0.00 | 0.00 | 0.00 |
| I5 | | 0.00 | 0.00 | 0.00 | 0.00 | 0.00 | 0.00 |
| C5 | | 0.00 | 0.00 | 0.00 | 0.00 | 0.00 | 0.00 |
| C6 | | 0.00 | 0.00 | 0.00 | 0.00 | 0.00 | 0.00 |
| BZ | | 0.00 | 0.00 | 0.00 | 0.00 | 0.00 | 0.00 |
| C7 | | 0.00 | 0.00 | 0.00 | 0.00 | 0.00 | 0.00 |

TABLE 1-continued

| | | | | | | | |
|---|---|---|---|---|---|---|---|
| C8 | | 0.00 | 0.00 | 0.00 | 0.00 | 0.00 | 0.00 |
| CD | | 0.00 | 0.00 | 0.01 | 0.01 | 0.00 | 0.00 |
| Total | | 100.00 | 100.00 | 100.00 | 100.00 | 100.00 | 100.00 |

| | | Stream # | | | | | |
|---|---|---|---|---|---|---|---|
| | | 166 | 168 | 169 | 171 | 173 | 175 |
| Temperature | ° C. | −97.0 | −118.0 | −118.0 | 27.1 | 30.0 | −21.3 |
| Pressure | bara | 27.7 | 16.8 | 16.8 | 16.3 | 89.6 | 88.6 |
| Vapor Fraction | — | 0.00 | 0.00 | 1.00 | 1.00 | 1.00 | 1.00 |
| Flow | kgmol/hr | 15,605 | 29,658 | 11,584 | 11,584 | 8,347 | 3,201 |
| Composition | mol % | | | | | | |
| N2 | | 1.25 | 5.16 | 23.75 | 23.75 | 3.78 | 3.78 |
| C1 | | 92.29 | 91.12 | 76.14 | 76.14 | 94.40 | 94.40 |
| C2 | | 5.87 | 3.38 | 0.12 | 0.12 | 1.69 | 1.69 |
| C3 | | 0.58 | 0.33 | 0.00 | 0.00 | 0.13 | 0.13 |
| I4 | | 0.00 | 0.00 | 0.00 | 0.00 | 0.00 | 0.00 |
| C4 | | 0.00 | 0.00 | 0.00 | 0.00 | 0.00 | 0.00 |
| I5 | | 0.00 | 0.00 | 0.00 | 0.00 | 0.00 | 0.00 |
| C5 | | 0.00 | 0.00 | 0.00 | 0.00 | 0.00 | 0.00 |
| C6 | | 0.00 | 0.00 | 0.00 | 0.00 | 0.00 | 0.00 |
| BZ | | 0.00 | 0.00 | 0.00 | 0.00 | 0.00 | 0.00 |
| C7 | | 0.00 | 0.00 | 0.00 | 0.00 | 0.00 | 0.00 |
| C8 | | 0.00 | 0.00 | 0.00 | 0.00 | 0.00 | 0.00 |
| CD | | 0.01 | 0.00 | 0.00 | 0.00 | 0.00 | 0.00 |
| Total | | 100.00 | 100.00 | 100.00 | 100.00 | 100.00 | 100.00 |

| | | Stream # | | | | | |
|---|---|---|---|---|---|---|---|
| | | 177 | 179 | 181 | 182 | 184 | 186 |
| Temperature | ° C. | −116.0 | −142.4 | 26.0 | 30.0 | −22.2 | −140.4 |
| Pressure | bara | 86.2 | 4.4 | 4.0 | 89.6 | 88.9 | 88.3 |
| Vapor Fraction | — | 0.00 | 1.00 | 1.00 | 1.00 | 1.00 | 0.00 |
| Flow | kgmol/hr | 5,146 | 6,846 | 6,846 | 4,631 | 1,690 | 2,940 |
| Composition | mol % | | | | | | |
| N2 | | 3.78 | 17.78 | 17.78 | 3.78 | 3.78 | 3.78 |
| C1 | | 94.40 | 82.19 | 82.19 | 94.40 | 94.40 | 94.40 |
| C2 | | 1.69 | 0.03 | 0.03 | 1.69 | 1.69 | 1.69 |
| C3 | | 0.13 | 0.00 | 0.00 | 0.13 | 0.13 | 0.13 |
| I4 | | 0.00 | 0.00 | 0.00 | 0.00 | 0.00 | 0.00 |
| C4 | | 0.00 | 0.00 | 0.00 | 0.00 | 0.00 | 0.00 |
| I5 | | 0.00 | 0.00 | 0.00 | 0.00 | 0.00 | 0.00 |
| C5 | | 0.00 | 0.00 | 0.00 | 0.00 | 0.00 | 0.00 |
| C6 | | 0.00 | 0.00 | 0.00 | 0.00 | 0.00 | 0.00 |
| BZ | | 0.00 | 0.00 | 0.00 | 0.00 | 0.00 | 0.00 |
| C7 | | 0.00 | 0.00 | 0.00 | 0.00 | 0.00 | 0.00 |
| C8 | | 0.00 | 0.00 | 0.00 | 0.00 | 0.00 | 0.00 |
| CD | | 0.00 | 0.00 | 0.00 | 0.00 | 0.00 | 0.00 |
| Total | | 100.00 | 100.00 | 100.00 | 100.00 | 100.00 | 100.00 |

| | | Stream # | | | | | |
|---|---|---|---|---|---|---|---|
| | | 189 | 190 | 191 | 192 | 194 | 197 |
| Temperature | ° C. | 30.0 | 30.0 | 30.0 | −142.4 | −161.5 | 30.0 |
| Pressure | bara | 83.9 | 83.9 | 83.9 | 4.5 | 1.1 | 83.9 |
| Vapor Fraction | — | 1.00 | 1.00 | 1.00 | 0.00 | 1.00 | 1.00 |
| Flow | kgmol/hr | 18,431 | 2,007 | 16,424 | 25,751 | 4,067 | 4,067 |
| Composition | mol % | | | | | | |
| N2 | | 21.53 | 21.53 | 21.53 | 1.65 | 8.74 | 8.74 |
| C1 | | 78.38 | 78.38 | 78.38 | 93.87 | 91.25 | 91.25 |
| C2 | | 0.08 | 0.08 | 0.08 | 4.08 | 0.01 | 0.01 |
| C3 | | 0.00 | 0.00 | 0.00 | 0.39 | 0.00 | 0.00 |
| I4 | | 0.00 | 0.00 | 0.00 | 0.00 | 0.00 | 0.00 |
| C4 | | 0.00 | 0.00 | 0.00 | 0.00 | 0.00 | 0.00 |
| I5 | | 0.00 | 0.00 | 0.00 | 0.00 | 0.00 | 0.00 |
| C5 | | 0.00 | 0.00 | 0.00 | 0.00 | 0.00 | 0.00 |
| C6 | | 0.00 | 0.00 | 0.00 | 0.00 | 0.00 | 0.00 |
| BZ | | 0.00 | 0.00 | 0.00 | 0.00 | 0.00 | 0.00 |
| C7 | | 0.00 | 0.00 | 0.00 | 0.00 | 0.00 | 0.00 |
| C8 | | 0.00 | 0.00 | 0.00 | 0.00 | 0.00 | 0.00 |
| CD | | 0.00 | 0.00 | 0.00 | 0.00 | 0.00 | 0.00 |
| Total | | 100.00 | 100.00 | 100.00 | 100.00 | 100.00 | 100.00 |

TABLE 1-continued

| | | Stream # | |
|---|---|---|---|
| | | 198 | 199 |
| Temperature | ° C. | 30.0 | −94.8 |
| Pressure | bara | 83.9 | 72.9 |
| Vapor Fraction | — | 1.00 | 0.00 |
| Flow | kgmol/hr | 20,490 | 20,490 |
| Composition | mol % | | |
| N2 | | 18.99 | 18.99 |
| C1 | | 80.94 | 80.94 |
| C2 | | 0.07 | 0.07 |
| C3 | | 0.00 | 0.00 |
| I4 | | 0.00 | 0.00 |
| C4 | | 0.00 | 0.00 |
| I5 | | 0.00 | 0.00 |
| C5 | | 0.00 | 0.00 |
| C6 | | 0.00 | 0.00 |
| BZ | | 0.00 | 0.00 |
| C7 | | 0.00 | 0.00 |
| C8 | | 0.00 | 0.00 |
| CD | | 0.00 | 0.00 |
| Total | | 100.00 | 100.00 |

It will be appreciated that the invention is not restricted to the details described above with reference to the preferred embodiments but that numerous modifications and variations can be made without departing from the spirit or scope of the invention as defined in the following claims.

The invention claimed is:

1. A method for removing natural gas liquids from and liquefying a natural gas feed stream, the method comprising the steps of:

(a) expanding and/or cooling a natural gas feed stream and introducing said stream into a distillation column having one or more separation sections, the natural gas feed stream being introduced into the distillation column below at least one of said separation sections;

(b) withdrawing a natural gas liquids stream from the bottom of the distillation column;

(c) withdrawing a natural gas vapor stream from the top of the distillation column (d) warming the natural gas vapor stream and a first expanded refrigerant stream in one or more heat exchanger sections, compressing the resulting warmed streams, and combining said streams to form a compressed refrigerant, wherein the natural gas vapor stream and first expanded refrigerant stream are may be combined prior to, during or after being warmed and compressed;

(e) cooling a first portion of the compressed refrigerant and a second portion of the compressed refrigerant, via indirect heat exchange with the natural gas vapor stream and the first expanded refrigerant stream that are being warmed in step (d), to form respectively a first cold refrigerant stream and a second cold refrigerant stream, the first and second portions of the compressed refrigerant being cooled against the natural gas vapor stream and the first expanded refrigerant stream and the first portion of the compressed refrigerant being then further cooled against the natural gas vapor stream and the first expanded refrigerant stream such that the first cold refrigerant stream is formed at a lower temperature than the second cold refrigerant stream;

(f) expanding the first cold refrigerant stream, expanding the second cold refrigerant stream, and combining and separating the resulting expanded streams into vapor and liquid phases to form a first liquefied natural gas stream from the liquid phase and the first expanded refrigerant stream from the vapor phase;

(g) forming a reflux stream and expanding and introducing the reflux stream into the top of the distillation column to provide reflux to the distillation column, wherein the reflux stream is formed from a portion of the first liquefied natural gas stream, a portion of the liquid phase separated in step (f), a portion of the first cold refrigerant stream withdrawn from said stream prior to said stream being separated in step (f), a further portion of the compressed refrigerant that has been cooled via indirect heat exchange with the natural gas vapor stream and the first expanded refrigerant stream that are being warmed in step (d), and/or a portion of a liquefied natural gas stream or liquefied natural gas product derived from the first liquefied natural gas stream.

2. The method of claim 1, wherein in step (a) the distillation column into which the natural gas feed stream is introduced has two or more separation sections, the expanded natural gas feed stream being introduced into the distillation column below at least one of said separation sections and above at least another one of said separation sections.

3. The method of claim 2, wherein the method further comprises the step of:

(h) providing boil-up to the distillation column by reboiling a portion of the distillation column bottoms liquid.

4. The method of claim 1, wherein in step (a) the natural gas feed stream is expanded before being introduced into the distillation column.

5. The method of claim 4, wherein in step (a) the natural gas feed stream is cooled and then expanded before being introduced into the distillation column, wherein after being cooled the natural gas feed stream is separated into vapor and liquid phases with the vapor phase being expanded and introduced into the distillation column at a first location below at least one separation section of the column, and with the liquid phase being expanded and introduced into the distillation column at a second location below the first location, there being at least one separation section between the first and second locations.

6. The method of claim 1, wherein in step (a) the natural gas feed stream is cooled before being introduced into the distillation column, at least a portion the natural gas feed stream being cooled via indirect heat exchange with the natural gas vapor stream and the first expanded refrigerant stream that are being warmed in step (d).

7. The method of claim 1, wherein in step (g) the reflux stream is formed from a portion of the first liquefied natural gas stream and/or a portion of the liquid phase separated in step (f).

8. The method of claim 1, wherein the first expanded refrigerant stream is formed at a lower temperature than the natural gas vapor stream, and wherein in step (e) the at least a first portion of the compressed refrigerant is cooled via indirect heat exchange with the natural gas vapor stream and the first expanded refrigerant stream and then further cooled via indirect heat exchange with the first expanded refrigerant stream to form the first cold refrigerant stream.

9. The method of claim 1, wherein the method further comprises the step of:

(i) expanding a third portion of the compressed refrigerant to form a second expanded refrigerant stream, wherein the second expanded refrigerant stream is formed at a higher temperature than the first expanded refrigerant stream or the natural gas vapor stream;

wherein step (d) comprises warming the natural gas vapor stream, the first expanded refrigerant stream and the second expanded refrigerant stream in one or more heat exchanger sections, compressing the resulting warmed streams, and combining said streams to form a compressed refrigerant, wherein the natural gas vapor stream, first expanded refrigerant stream and second expanded refrigerant stream are combined prior to, during or after being warmed and compressed; and wherein step (e) comprises cooling the first portion of the compressed refrigerant and the second portion of the compressed refrigerant, via indirect heat exchange with the natural gas vapor stream, the first expanded refrigerant stream and the second expanded refrigerant stream that are being warmed in step (d), to form respectively the first cold refrigerant stream and the second cold refrigerant stream, the first and second portions of the compressed refrigerant being cooled against the natural gas vapor stream, the first expanded refrigerant stream and the second expanded refrigerant stream, and the first portion of the compressed refrigerant being then further cooled against the natural gas vapor stream and the first expanded refrigerant stream such that the first cold refrigerant stream is formed at a lower temperature than the second cold refrigerant stream.

10. The method of claim 1, wherein the second cold refrigerant stream is expanded in an expander portion of a compander having a compressor portion that is used for compressing at least a portion of the natural gas vapor stream and/or first expanded refrigerant stream in step (d).

11. The method of claim 1, wherein in step (f) the resulting expanded streams are separated into vapor and liquid phases in one or more phase separators.

12. The method of claim 1, wherein the method further comprises the step of:

(j) further cooling at least a portion of the first liquefied natural gas stream to form a liquefied natural gas product stream.

13. The method of claim 12, wherein step (j) comprises flashing at least a portion of the first liquefied natural gas stream to form the liquefied natural gas product stream and one or more flash gas streams.

14. The method of claim 13, wherein the method further comprises the step of:

(k) cooling and liquefying a fourth portion of the of the compressed refrigerant via indirect heat exchange with the one or more flash gas streams to form a second liquefied natural gas stream or set of liquefied natural gas streams; and wherein step (j) comprises flashing the at least a portion of the first liquefied natural gas stream and the second liquefied natural gas stream or set of liquefied natural gas streams to form the liquefied natural gas product stream and the one or more flash gas streams.

15. The method of claim 14, wherein the method further comprises the step of:

(l) cooling a fifth portion of the compressed refrigerant via indirect heat exchange with the one or more flash gas streams and then combining the fifth portion of the compressed refrigerant with the first portion of the compressed refrigerant during the cooling of the at least a first portion of the compressed refrigerant in step (e) to form the first cold refrigerant stream.

16. The method of claim 13, wherein the method further comprises the step of:

(m) compressing the one or more flash gas streams to form a compressed flash gas stream, and cooling and liquefying the compressed flash gas stream, via indirect heat exchange with the natural gas vapor stream and the first expanded refrigerant stream that are being warmed in step (d), to form a third liquefied natural gas stream; and wherein step (j) comprises flashing the at least a portion of the first liquefied natural gas stream and the third liquefied natural gas stream to form the liquefied natural gas product stream and the one or more flash gas streams.

17. The method of claim 13, wherein the method further comprises the step of:

(m) compressing and combining the one or more flash gas streams with the natural gas vapor stream and the first expanded refrigerant stream to form the compressed refrigerant.

18. A system for removing natural gas liquids from and liquefying a natural gas feed stream, the system comprising:

one or more expansion devices and/or heat exchanger sections arranged and configured to expanding and/or cool a natural gas feed stream to form an expanded and/or cooled natural gas feed stream;

a distillation column having one or more separation sections, the distillation column being arranged and configured to receive the expanded and/or cooled natural gas feed stream into the distillation column below at least one of said separation sections and separate expanded and/or cooled natural gas feed stream into a natural gas liquids stream withdrawn from the bottom of the distillation column and a natural gas vapor stream withdrawn from the top of the distillation column;

one or more conduits, heat exchanger sections and compression stages arranged and configured to receive and warm the natural gas vapor stream and a first expanded refrigerant stream, compress the resulting warmed streams and combine said streams to form a compressed refrigerant, wherein the one or more conduits, heat exchanger sections and compression stages and are arranged and configured such that the natural gas vapor stream and first expanded refrigerant stream are combined prior to, during or after being warmed and compressed;

one or more conduits arranged and configured to pass a first portion of the compressed refrigerant and a second portion of the compressed refrigerant through the one or more heat exchanger sections so as to cool the first portion of the compressed refrigerant and the second portion of the compressed refrigerant via indirect heat exchange with the natural gas vapor stream and the first expanded refrigerant stream, to form respectively a first cold refrigerant stream and a second cold refrigerant stream, the first and second portions of the compressed refrigerant being cooled against the natural gas vapor stream and the first expanded refrigerant stream and the first portion of the compressed refrigerant being then further cooled against the natural gas vapor stream and the first expanded refrigerant stream such that the first cold refrigerant stream is formed at a lower temperature than the second cold refrigerant stream;

one or more expansion and separation devices arranged and configured to expand the first cold refrigerant stream, expand the second cold refrigerant stream, and combine and separate the resulting expanded streams into vapor and liquid phases to form a first liquefied natural gas stream from the liquid phase and the first expanded refrigerant stream from the vapor phase; and one or more conduits and expansion devices arranged and configured to receive a reflux stream and expand and introduce the reflux stream into the top of the distillation column to provide reflux to the distillation column, wherein the reflux stream is formed from a portion of the first liquefied natural gas stream, a portion of the liquid phase separated in step (f), a portion of the first cold refrigerant stream withdrawn from said stream prior to said stream being separated in step (f), a further portion of the compressed refrigerant that has been cooled via indirect heat exchange with the natural gas vapor stream and the first expanded refrigerant stream that are being warmed in step (d), and/or a portion of a liquefied natural gas stream or liquefied natural gas product derived from the first liquefied natural gas stream.

* * * * *